US006397623B1

(12) United States Patent
Takachi

(10) Patent No.: US 6,397,623 B1
(45) Date of Patent: Jun. 4, 2002

(54) COOLING DEVICE

(75) Inventor: Ken Takachi, Osaka (JP)

(73) Assignee: Longwell Japan Co., Ltd., Osaka (JP)

( * ) Notice: Subject to any disclaimer, the term of this patent is extended or adjusted under 35 U.S.C. 154(b) by 0 days.

(21) Appl. No.: 09/744,955

(22) PCT Filed: Aug. 11, 1999

(86) PCT No.: PCT/JP99/04363

§ 371 (c)(1),
(2), (4) Date: Apr. 25, 2001

(87) PCT Pub. No.: WO00/77461

PCT Pub. Date: Dec. 21, 2000

(30) Foreign Application Priority Data

Nov. 6, 1999 (JP) ..... 11/165970
Nov. 6, 1999 (JP) ..... 11/165971

(51) Int. Cl.[7] ..... F25D 9/00
(52) U.S. Cl. ..... 62/403
(58) Field of Search ..... 62/403, 401

(56) References Cited

U.S. PATENT DOCUMENTS

| | | | | |
|---|---|---|---|---|
| 2,020,923 A | | 11/1935 | Von Seggern | 62/136 |
| 3,214,938 A | | 11/1965 | Zotos | 62/402 |
| 3,803,857 A | | 4/1974 | Ishizaki | 62/6 |
| 3,896,632 A | | 7/1975 | Huntley | 62/88 |
| 3,937,030 A | | 2/1976 | Jaspers | 62/86 |
| 4,335,579 A | * | 6/1982 | Sugimoto | 62/6 |
| 4,420,944 A | | 12/1983 | Dibrell | 62/86 |
| 4,734,011 A | | 3/1988 | Hall, Jr. | 417/2 |
| 4,738,105 A | * | 4/1988 | Ross et al. | 60/517 |
| 4,754,612 A | | 7/1988 | Dibrell et al. | 62/87 |
| 5,146,749 A | * | 9/1992 | Wood et al. | 60/517 |
| 5,732,560 A | | 3/1998 | Thuresson et al. | 62/87 |
| 5,737,924 A | * | 4/1998 | Taguchi et al. | 62/6 |

FOREIGN PATENT DOCUMENTS

| | | |
|---|---|---|
| DE | 35 44 445 A1 | 6/1987 |
| EP | 0 667 499 A1 | 8/1995 |
| JP | 06323655 A | 11/1994 |
| JP | 06323658 A | 11/1994 |

* cited by examiner

*Primary Examiner*—William Doerrler
*Assistant Examiner*—Malik N. Drake
(74) *Attorney, Agent, or Firm*—Arent Fox Kintner Plotkin & Kahn

(57) ABSTRACT

An object of the present invention is to provide a cooling device which solves various problems such as the economical efficiency, pulsation of cold air, etc. In a cooling device of the present invention, the compressor and the expander are coupled to one crank shaft or interlocked crank shafts so as to use the expansion energy from the compressed air in the expander as an energy for compressing the outside air in the compressor, thereby reducing the running cost. Moreover, a plurality of expanders are operated with a predetermined phase difference with respect to one another so as to reduce the pulsation of the cold air. Furthermore, an air dryer is provided along a pipe for introducing air into the expander so as to dehumidify the air before expansion. Moreover, the crank device for the compressor and the expander is preferably provided with a planetary gear mechanism.

15 Claims, 19 Drawing Sheets

(A)

(B)

COOLING DEVICE

TECHNICAL FIELD

The present invention relates to a cooling device using air as a refrigerant.

BACKGROUND ART

In recent years, the degradation of the environment surrounding the earth due to flon gas, such as the ozone layer depletion and global warming, has become a serious problem. Therefore, there are trends toward environment-friendly cooling devices which do not use flon gas. As one of the trends, clean and safe cooling devices using natural air as a refrigerant have been under development.

A cooling device using air as a refrigerant typically takes in and compresses the outside air through a compressor, leads the compressed and heated air to a heat exchanger for cooling to about room temperature, and leads the air to an expander for adiabatic expansion. The temperature of the air is reduced to a low temperature on the order of minus ten degrees. The cold air is led to a freezing chamber to absorb heat from, and freeze, an object.

However, the cooling device as described above has the following problems in practice:

(1) The compressor and the expander are driven by separate driving systems. The device is uneconomical because the compressor requires an energy for compressing the outside air, and the expander requires an energy for expanding the compressed air, whereby the power consumption accumulates to increase the running cost.

(2) The cold air may have pulsation based on the operation phase of the expander. In order to constantly cool the object, it is desired to suppress such pulsation in the cold air.

(3) In the expander, the temperature of the air decreases rapidly to a temperature on the order of minus several ten (°C.), whereby moisture contained in the air in the expander may lead to dew formation/icing onto the discharge valve, etc., of the expansion cylinder, thereby hampering the operation of the cooling device.

(4) It is desired to further improve the cooling efficiency and the energy efficiency during operation of the cooling device.

Thus, an object of the present invention is to provide a cooling device using air as a refrigerant which solves the above-described problems.

DISCLOSURE OF THE INVENTION

In order to achieve the above-described object, a cooling device of the present invention comprises: one or a plurality of compression, cylinders each accommodating therein a compression piston so as to allow reciprocating motion thereof; a plurality of expansion cylinders each accommodating therein an expansion piston so as to allow reciprocating motion thereof; one crank shaft or a plurality of crank shafts rotating in an interlocked manner; a first crank mechanism for coupling the compression pistons so as to allow reciprocating motion thereof from the crank shaft via a crank pin; a second crank mechanism for coupling the expansion pistons so as to allow reciprocating motion thereof from the crank shaft via a crank pin; a driving device for rotating the crank shaft; a compressed air supply passage for communicating a discharge port of each compression cylinder with an intake port of each expansion cylinder, the discharge port being provided for discharging a compressed air which is introduced through an intake port of the compression cylinder and compressed within the compression cylinder; a primary cooler provided along the compressed air supply passage; and a cold air discharge manifold for discharging the air whose temperature is reduced through adiabatic expansion within the respective expansion cylinders to the outside.

Means for reducing the pulsation of the cold air comprises: the plurality of expansion cylinders; one crank shaft or a plurality of crank shafts rotating in an interlocked manner with the same cycle; a second crank mechanism for coupling the respective expansion pistons so as to allow reciprocating motion thereof from the crank shaft via a crank pin with a predetermined phase difference with respect to one another; and a cold air discharge manifold for communicating together a plurality of discharge ports for discharging the air whose temperature is reduced through adiabatic expansion within the respective expansion cylinders to the outside.

Means for preventing the dew formation or icing within the expansion cylinder, etc., comprises an air drying device provided in an intake passage for introducing air into the intake port of the compression cylinder or in the compressed air supply passage.

In such a case, if the air drying device is provided upstream of the primary cooler along the compressed air supply passage, a secondary cooler is provided between the air drying device and the compression cylinder.

Means for improving the cooling efficiency and/or the energy efficiency during operation comprises, for example, an introduction pipe which is provided so as to introduce air from the cold air discharge space of the cold air discharge manifold into the intake port of the compression cylinder, and an introduction pipe which is provided so as to introduce a part of the air within the cold air discharge manifold into the compression cylinder.

In a cooling device of the present invention, a flywheel for ensuring a stable operation of the cooling device is provided for one of the crank shafts.

In a cooling device of the present invention, the adiabatic cylinder is formed by inner and outer tubes layered together, the inner tube being made of a stainless steel.

In a cooling device of the present invention, as means for improving the cooling efficiency and/or the energy efficiency during operation, each two of the cylinders are provided along the same cylinder axis line so as to oppose each other with respective cylinder heads thereof facing away from each other, the cooling device comprising: a piston rod for coupling together respective pistons of the both cylinders and linearly reciprocating along the cylinder axis line; and a crank mechanism comprising an inner periphery sun gear in which a central axis of a pitch circle thereof orthogonally crosses the cylinder axis line and which is fixedly provided in parallel to the cylinder axis line, a planetary gear having a pitch circle diameter which is one half of the pitch circle diameter of the inner periphery sun gear, the planetary gear being capable of rotating and revolving while meshing with the inner periphery sun gear, a crank shaft rotatably provided about the central axis of the pitch circle of the inner periphery sun gear, and an arm portion protruding in a radial direction of the crank shaft for rotatably supporting a rotation axis of the planetary gear, wherein an intermediate portion of the piston rod is pin-engaged along a circumference of the pitch circle of the planetary gear.

A cooling device of the present invention comprises: a cylinder unit comprising a compression cylinder accommodating therein a compression piston so as to allow reciprocating motion thereof and a plurality of expansion cylinders each accommodating therein an expansion piston so as to allow reciprocating motion thereof, the cylinders being provided along the same cylinder axis line with the respective cylinder heads thereof facing away from each other; a piston rod for coupling together the compression piston and the expansion pistons of the cylinder unit and linearly reciprocating along the axis line of the cylinder unit; a crank mechanism comprising an inner periphery sun gear in which a central axis of a pitch circle thereof orthogonally crosses the cylinder axis line between the cylinders of the cylinder unit and which is fixedly provided in parallel to the cylinder axis line, a planetary gear having a pitch circle diameter which is one half of the pitch circle diameter of the inner periphery sun gear, the planetary gear being capable of rotating and revolving while meshing with the inner periphery sun gear, a crank shaft rotatably provided about the central axis of the pitch circle of the inner periphery sun gear, and an arm portion protruding in a radial direction of the crank shaft for rotatably supporting a rotation axis of the planetary gear, wherein an intermediate portion of the piston rod is pin-engaged along a circumference of the pitch circle of the planetary gear; a driving device for rotating the crank shaft; a compressed air supply passage for communicating a discharge port of the compression cylinder with an intake port of each expansion cylinder, the discharge port being provided for discharging a compressed air which is introduced through an intake port of the compression cylinder and compressed within the compression cylinder; a primary cooler provided along the compressed air supply passage; and a cold air discharge manifold for communicating together discharge ports for discharging the air whose temperature is reduced through adiabatic expansion within the respective expansion cylinders to the outside.

A cooling device of the present invention may comprise a cam mechanism, wherein a cam follower is provided at a pin engagement section between the planetary gear and the piston rod, and a cam guide surface is set so that the planetary gear meshes with the sun gear on a front side with respect to a rotation direction thereof before the expansion piston reaches a top dead center. The cam mechanism may have a cam guide surface which is set so that the planetary gear meshes with the sun gear on a front side with respect to a rotation direction thereof before the expansion piston reaches a bottom dead center.

A cooling device of the present invention comprises: a compression cylinder unit in which two compression cylinders each accommodating therein a compression piston so as to allow reciprocating motion thereof are provided along the same cylinder axis line with respective cylinder heads thereof facing away from each other; an expansion cylinder unit in which two expansion cylinders each accommodating therein a expansion piston so as to allow reciprocating motion thereof are provided along the same cylinder axis line with respective cylinder heads thereof facing away from each other; a plurality of piston rods provided respectively for the cylinder units, each piston rod coupling together the two pistons of each cylinder unit and linearly reciprocating along the axis line of the cylinder unit; a crank mechanism comprising an inner periphery sun gear in which a central axis of a pitch circle thereof orthogonally crosses the cylinder axis line between the cylinders of each cylinder unit and which is fixedly provided in parallel to the cylinder axis line, a planetary gear having a pitch circle diameter which is one half of the pitch circle diameter of the inner periphery sun gear, the planetary gear being capable of rotating and revolving while meshing with the inner periphery sun gear, a crank shaft rotatably provided about the central axis of the pitch circle of the inner periphery sun gear, and an arm portion protruding in a radial direction of the crank shaft for rotatably supporting a rotation axis of the planetary gear, wherein an intermediate portion of the piston rod is pin-engaged along a circumference of the pitch circle of the planetary gear; power transmission means for interlocking the crank shafts provided in the respective cylinder units with each other; a driving device for rotating the crank shaft; a compressed air supply passage for communicating a discharge port of each compression cylinder with an intake port of each expansion cylinder, the discharge port being provided for discharging a compressed air which is introduced through an intake port of the compression cylinder and compressed within the compression cylinder; a primary cooler provided along the compressed air supply passage; and a cold air discharge manifold for communicating together discharge ports for discharging the air whose temperature is reduced through adiabatic expansion within the respective expansion cylinders to the outside.

In a cooling device of the present invention, a compressed air is supplied into the compressed air supply passage, the compressed air being produced by a pressurizing compressor which can be operated as necessary. In such a case, the device may further comprise a depressurizing device provided along the compressed air supply passage, and a temperature sensor for measuring the temperature of the produced cold air, so that the pressure of the air within the compressed air supply passage is increased and decreased based on the temperature sensor so as to obtain a cold air of a desired temperature.

BEST MODE FOR CARRYING OUT THE INVENTION

Embodiments of the cooling device according to the present invention will now be described with reference to the figures.

Figure 1:
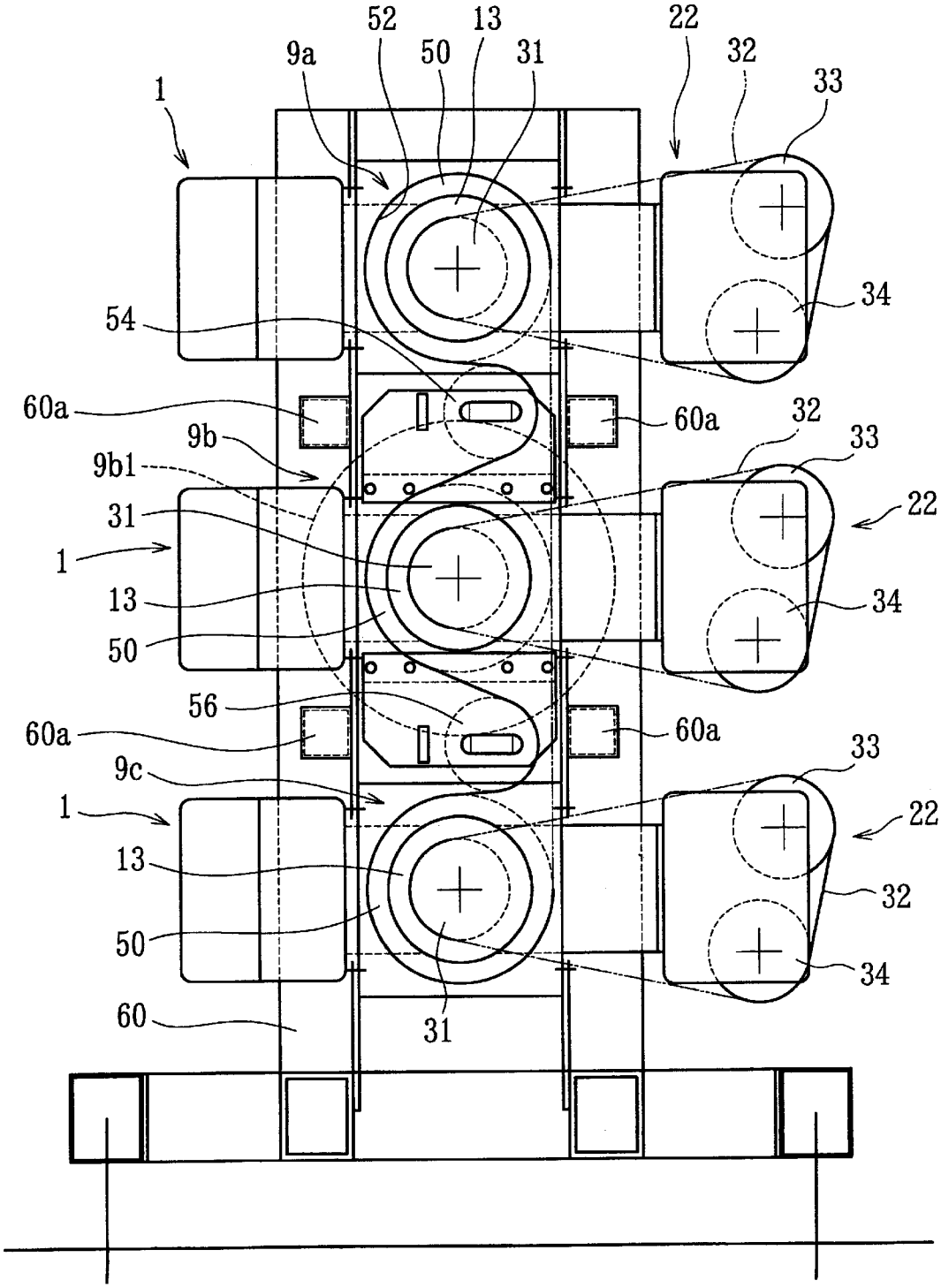
FIG. 1 is a diagram illustrating the entire structure of a cooling device according to a first embodiment of the present invention.
Figure 2:
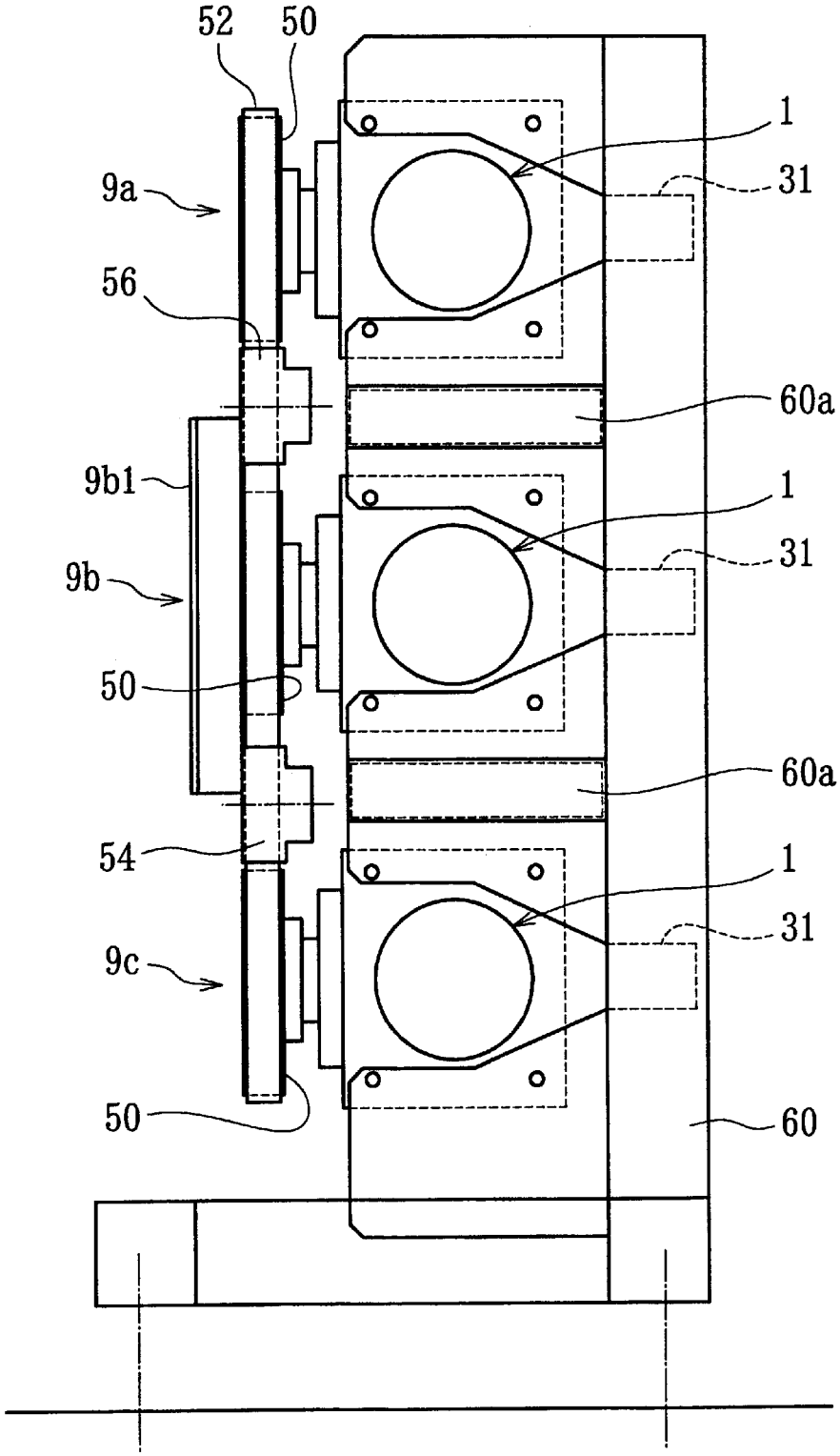
FIG. 2 is a diagram illustrating the entire structure of the cooling device according to the first embodiment of the present invention.

In the first embodiment, a single cooling unit includes a compressor 1, pipes (6, 21) as compressed air supply passages, a first heat exchanger 5 as a primary cooler, an expander 22, a discharge tube 26, piston rods (8, 39), a crank device 9, and a driving motor 10 as a driving device, as illustrated in FIG. 1 and FIG. 2. Three single cooling units are provided on a system base 60 in parallel to one another, with the discharge tube 26 of each cooling unit being coupled to a cold air discharge manifold 70 (see FIG. 3), as illustrated in FIG. 1 and FIG. 2.

The system base 60 supports the cooling units so that they are equidistantly arranged along the vertical direction, and has support arms 60*a* for supporting the respective cooling units.

Figure 3:
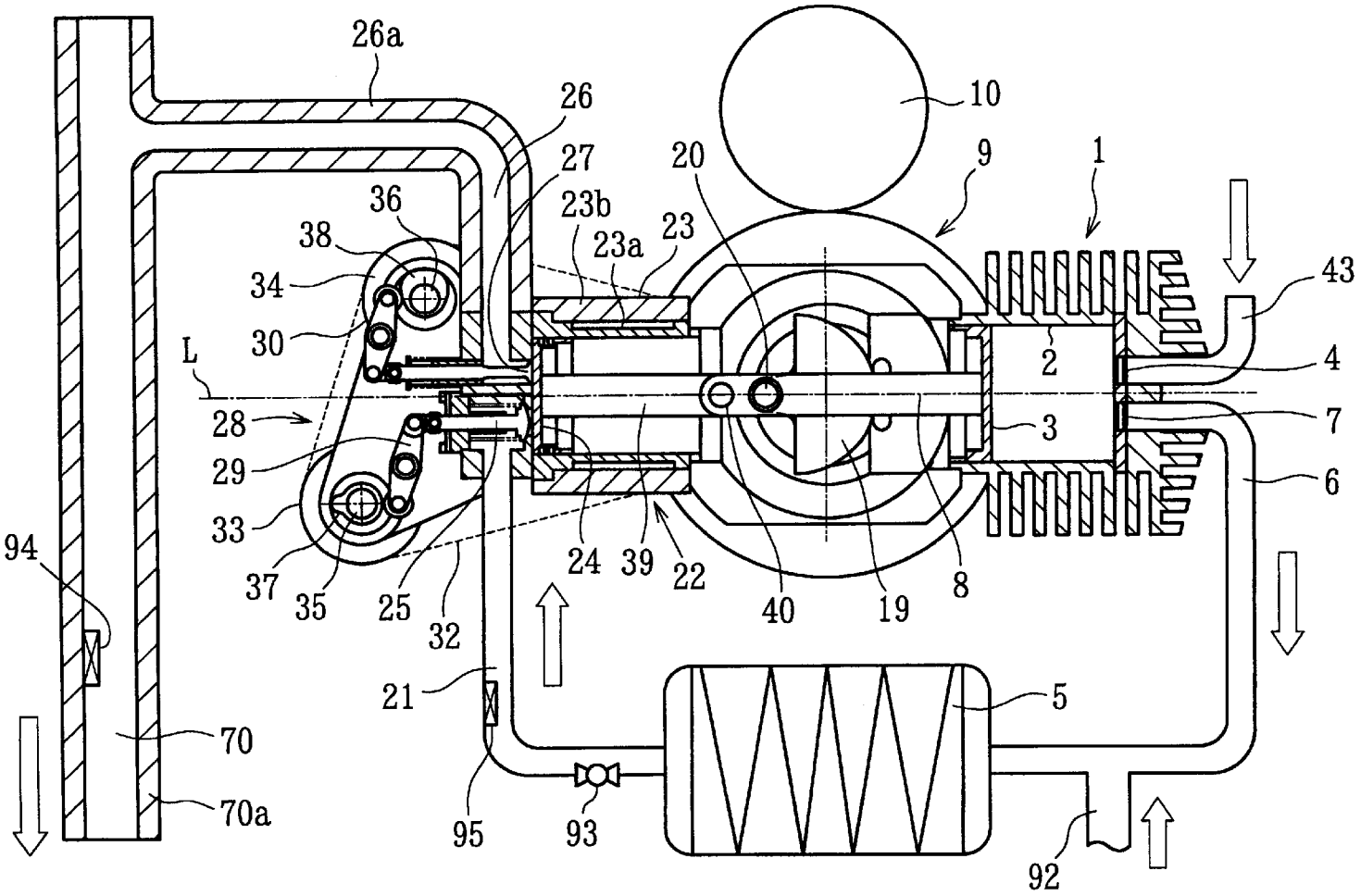
FIG. 3 is a longitudinal-sectional view illustrating an important part of the structure of a single cooling unit according to the first embodiment of the present invention.
Figure 4:
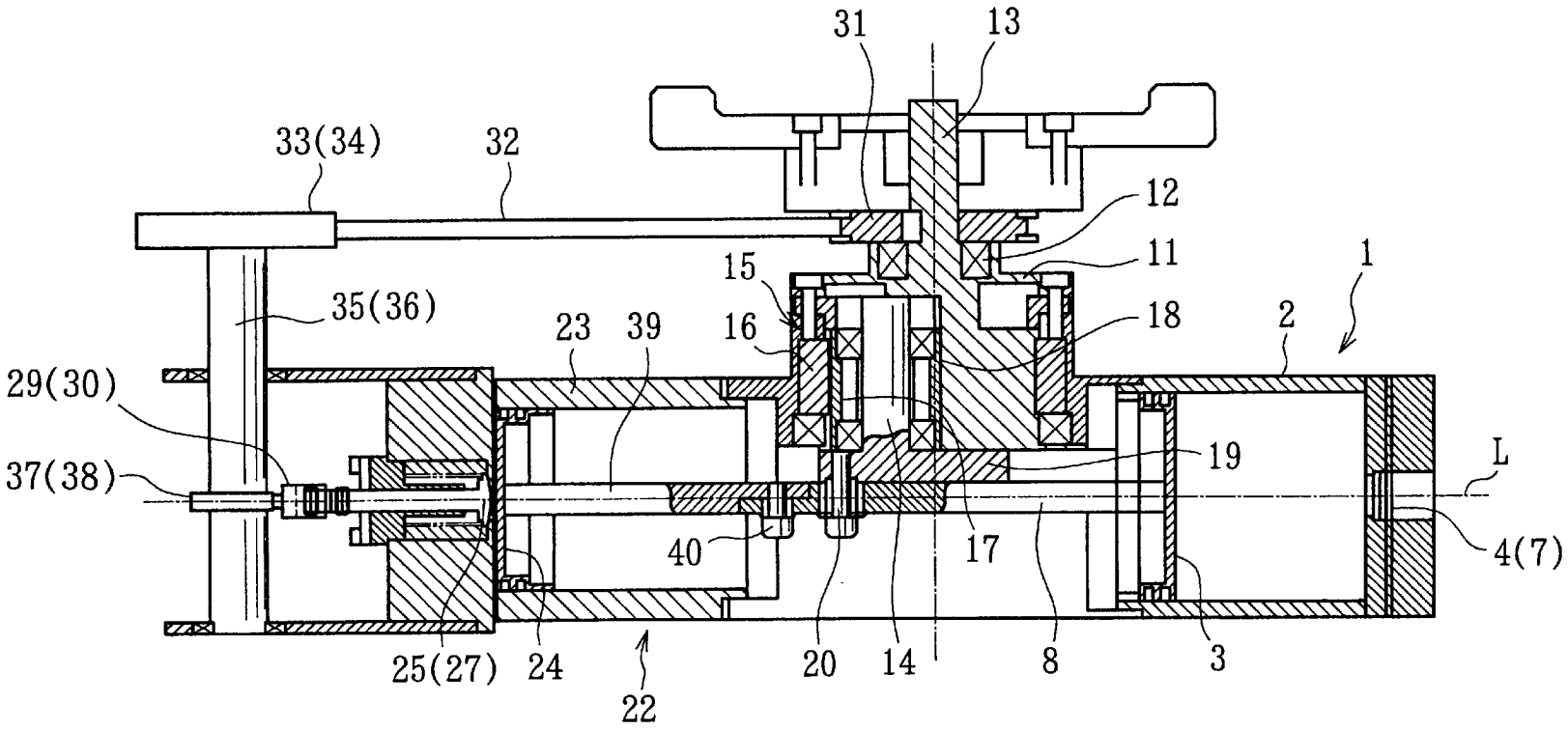
FIG. 4 is a cross-sectional view illustrating an important part of FIG. 3.

FIG. 3 and FIG. 4 each illustrate the structure of a single cooling unit.

The compressor 1 includes a compression piston 3 which is accommodated within a compression cylinder 2 so as to allow reciprocating motion of the compression piston 3. The head portion of the compression cylinder 2 includes an intake valve 4 for controlling the intake of the outside air from an introduction pipe 43 into the compression cylinder 2, and a discharge valve 7 for controlling the discharge of the compressed air into the pipe 6. The intake valve 4 is an automatic valve which is pushed open by the outside air pressure. The discharge valve 7 is an automatic valve which is pushed open by a predetermined compressed air pressure. The compression piston 3 is coupled to the piston rod 8 which is protruding leftward in the figure and which is coupled to the driving motor 10 via the crank device 9. Thus, the compression piston 3 reciprocates between the top dead center and the bottom dead center along with the operation of the driving motor 10. The structure of the crank device 9 will be described later.

The first heat exchanger 5 passes therethrough cooling water which circulates between the first heat exchanger 5 and a cooling tower (not shown), for example, to provide primary cooling of the high-temperature compressed air sent from the compressor 1 through the pipe 6 so as to cool the compressed air to about room temperature through heat exchange with the cooling water. The compressed air which has been subjected to primary cooling in the first heat exchanger 5 is sent to the expander 22 through the pipe 21.

One first heat exchanger 5 is illustrated to be provided for each cooling unit. However, in the present embodiment, the pipes 6 of the plurality of cooling units are communicated together so that the compressed air flows are once gathered and subjected to primary cooling by using a single first heat exchanger, after which the cooled compressed air is distributed to the respective expanders 22.

Figure 5:
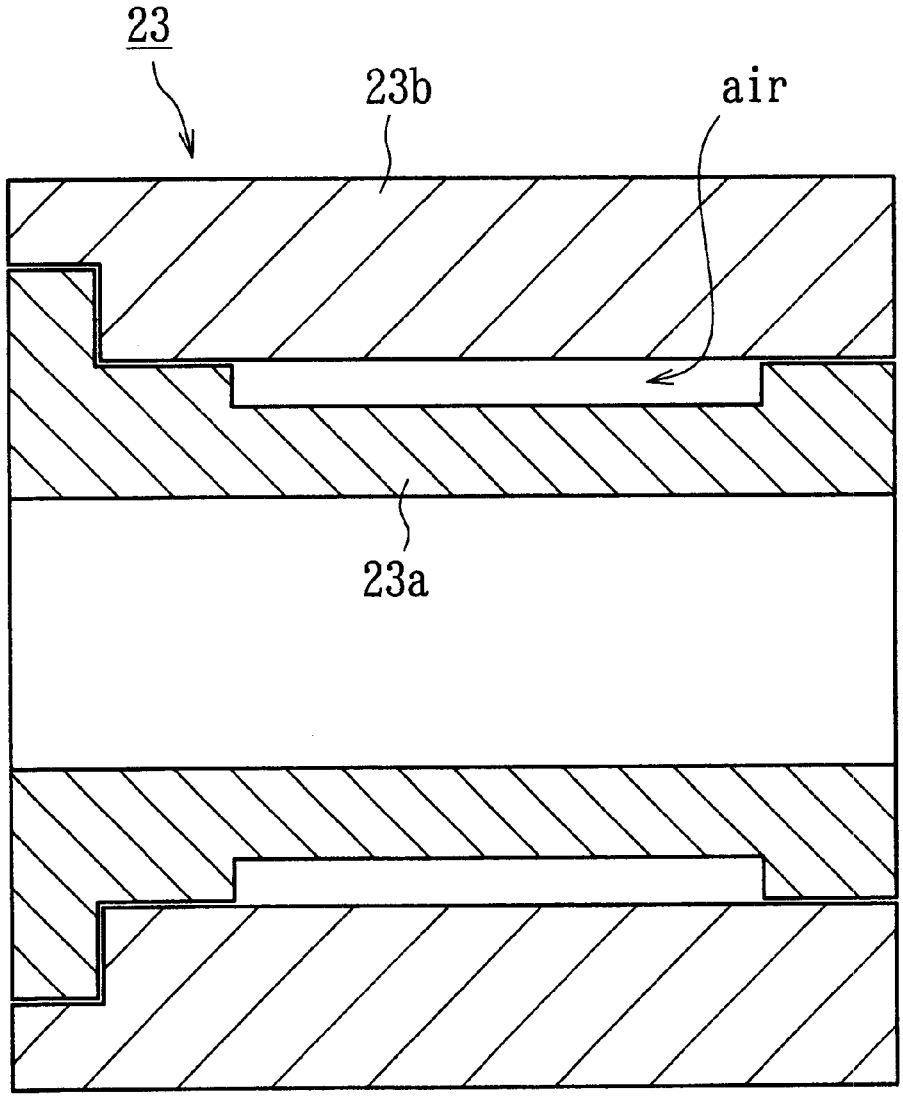
FIG. 5 is a longitudinal-sectional view illustrating an expansion cylinder according to the first embodiment of the present invention.

The expander 22 includes an expansion piston 24 which is accommodated within an expansion cylinder 23 so as to allow reciprocating motion of the expansion piston 24, the expansion cylinder 23 facing the compression cylinder 2 of the compressor 1 along the same cylinder axis line L. As illustrated in FIG. 5, the expansion cylinder 23 is an adiabatic cylinder which ensures thermal insulation of the air when expanded. For example, the expansion cylinder 23 is a three-layer cylinder including an inner tube 23*a* which is made of a stainless steel (whose thermal conductivity is small), an outer tube 23*b* which is made of an aluminum alloy, and air being enclosed between the inner tube 23*a* and the outer tube 23*b*. The expansion piston 24 is coupled to the piston rod 39 which is protruding rightward in the figure and which is pivotally coupled to the piston rod 8 by a pin 40 so that the expansion piston 24 reciprocates with a 180° phase difference with respect to the compression piston 3.

Thus, when the driving motor 10 is operated, thereby reciprocating the compression piston 3 of the compressor 1 between the top dead center and the bottom dead center, the expansion piston 24 reciprocates between the top dead center and the bottom dead center with the same cycle as the compression piston 3 but with a 180° phase difference with respect to the compression piston 3.

The head portion of the expansion cylinder 23 includes an intake value 25 for controlling the intake of air from the pipe 21, and a discharge valve 27 for controlling the discharge of the adiabatically-expanded low-temperature air into the discharge tube 26. The intake valve 25 and the discharge valve 27 are each opened/closed by a valve operating mechanism 28 at a predetermined timing.

In the valve operating mechanism 28, one end of two swayably-provided rocker arms (29, 30) is contacted with cams (37, 38) provided on cam shafts (35, 36) of timing pulleys (33, 34) which are rotated by a timing belt 32 in synchronization with a timing pulley 31 on the side of a crank shaft 13, with the other end of the rocker arm 29 and the other end of the rocker arm 30 being pressed against the respective tappet tips of the intake value 25 and the discharge valve 27. Thus, in the valve operating mechanism 28, the cam shafts (35, 36) rotate along with the cranking of the crank device 9, and the cams (37, 38) sway the rocker arms (29, 30), respectively, at a predetermined timing, thereby opening/closing the intake value 25 and the discharge valve 27 at a predetermined timing.

The discharge tube 26 is gathered by the cold air discharge manifold 70 with the discharge tubes 26 of the other cooling units provided in parallel. And the cold air is sent to an object to be cooled such as, for example, a freezing storage. The discharge tube 26 and the cold air discharge manifold 70 are covered with a thermal insulator 26*a* and a thermal insulator 70*a*, respectively, in order to ensure thermal insulation of the cold air which is discharged from the expander 22.

The crank device 9 is for converting the rotational motion of the driving motor 10 into a linear reciprocating motion of the piston rod 8. As illustrated in FIG. 4, the crank device 9 includes: the crank shaft 13 which is rotatably and axially supported within a crank case 11 via a bearing 12 and which is coupled to the driving motor 10; a coupling pin 20 which is coupled to the piston rod 8; and a planetary gear mechanism 15 which is provided between the crank shaft 13 and the coupling pin 20.

The planetary gear mechanism 15 will now be described with reference to FIG. 3, FIG. 4, FIG. 6 and FIG. 7.

The planetary gear mechanism 15 includes as its primary components an inner periphery sun gear 16 having its teeth along the inner peripheral surface thereof, and a planetary gear 17 having its teeth along the outer peripheral surface thereof.

The inner periphery sun gear 16 is fixedly provided in the crank case 11 so that the central axis 16*a* thereof is orthogonal to the cylinder axis line L and the central axis 16*a* coincides with the center of rotation of the crank shaft 13.

The planetary gear 17 is provided with a pitch circle diameter which is ½ of the pitch circle diameter of the inner periphery sun gear 16 so that the planetary gear 17 rolls along the inner periphery of the inner periphery sun gear 16. The planetary gear 17 includes a rotation shaft 14 which is rotatably and pivotally coupled to the center thereof via a bearing 18, and a counter balancer 19 for providing a rotational momentum which is integrally provided at an end of the rotation shaft 14.

The rotation shaft 14 of the planetary gear 17 serves as a crank pin and is axially supported on an arm portion 13*a* which is provided to radially protrude from the crank shaft 13.

Figure 6:
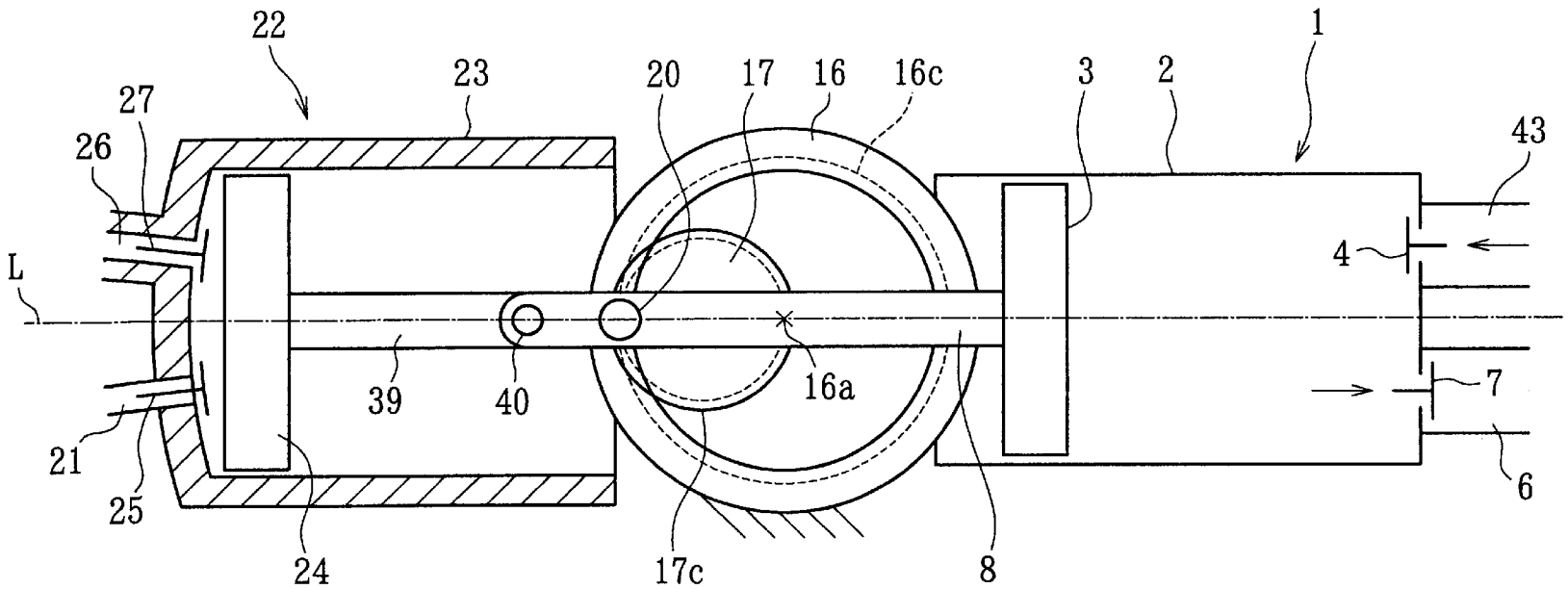
FIG. 6 is a schematic diagram illustrating a crank device according to the first embodiment of the present invention.

As illustrated in FIG. 6, the coupling pin 20 is provided at a position corresponding to the contact point between the pitch circle of the inner periphery sun gear 16 and the pitch circle of the planetary gear 17 when the diameter of a pitch circle 17*c* of the planetary gear 17 coincides with the cylinder axis line L on a side surface of the counter balancer 19. The coupling pin 20 rotatably and pivotally couples one end of the piston rod 8 of the compressor 1 via a bearing.

Figure 7:
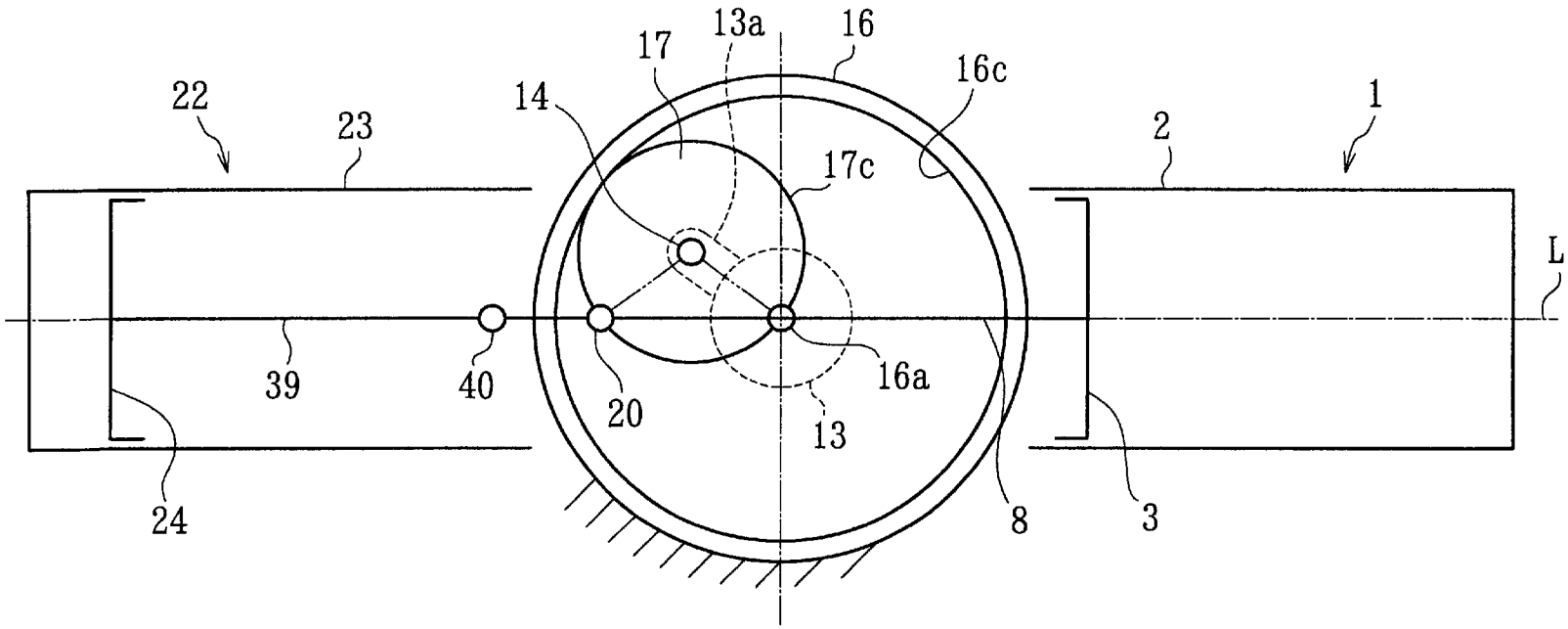
FIG. 7 is a schematic diagram illustrating the crank device according to the first embodiment of the present invention.

As illustrated in the schematic diagram of FIG. 7, the crank device 9 has the structure as described above, whereby the distance from the center of rotation of the crank shaft 13 to the rotation shaft 14 of the planetary gear 17 is equal to the distance from the rotation shaft 14 of the planetary gear 17 to the coupling pin 20 for coupling the piston rod 8, and the planetary gear 17 rotates twice per one revolution thereof. As a result, the coupling pin 20 linearly reciprocates along the cylinder axis line L for every revolution of the planetary gear 17. Thus, since the piston rod 8 linearly reciprocates substantially with no sway with respect to the cylinder axis line L, there is substantially no radial force acting upon the compression piston 3 and the expansion piston 24 which is coupled to the piston rod 39. Thus, so-called "piston slap" is unlikely to occur, thereby significantly reducing vibration, noise, cavitation, abrasion, etc.

The extent of the reciprocating motion of the piston rod 8 is equal to the distance between the top dead center and the bottom dead center of the cylinder, whereby the pitch circle diameter of the inner periphery sun gear 16 is set to be equal to the distance between the top dead center and the bottom dead center of the cylinder.

In this case, it is possible in principle to form the piston rod 8 and the piston rod 39 by an integral and continuous rod. However, in the present embodiment, they are coupled together by the pin 40 to be foldable so as to absorb the dimensional error among different parts, thereby smoothing the reciprocating motion of the compression piston 3 and the expansion piston 24.

In FIG. 1, in a crank device (9*a*, 9*b*, 9*c*) of each cooling unit, a single timing belt 52 is wound around timing pulleys 50 which are fitted around the respective crank shafts 13 of the crank devices so as to operate the cooling units which are provided in parallel to one another with a predetermined phase difference with respect to one another. The timing pulleys 50 and the timing belt 52 employ toothed pulleys and a toothed belt, respectively, so as to be meshed with each other and to eliminate slipping so that the operation timings of the cooling units are not shifted from one another. The cooling device according to the present embodiment includes three cooling units, and it is therefore designed so that the cooling units operate with a 120° phase difference with respect to one another. The pulleys labeled as 54 and 56 in FIG. 1 are idler pulleys for ensuring a required tension on the timing belt 52. As illustrated in FIG. 1 and FIG. 2, the three crank devices (9*a*, 9*b*, 9*c*) are interlocked together by the timing pulleys 50, and the center crank device 9*b* is provided with a large flywheel 9*b*1 so as to stabilize the operation of the entire cooling device. Thus, the operations of the other crank devices 9*a* and 9*c* are led by the operation of the center crank device 9*b*, thereby following the operation of the center crank device 9*b* with a predetermined phase difference.

The operation of the cooling device according to the first embodiment will now be described.

As described above, the compressor 1 takes in and compresses the outside air through the reciprocating motion of the compression piston 3 between the top dead center and the bottom dead center, and sends the high-temperature compressed air to the first heat exchanger 5. Specifically, when the compression piston 3 passes the top dead center and reverses to the bottom dead center, the air within the compression cylinder 2 is depressurized, whereby the intake valve 4 is pushed open by the outside air pressure, thus taking the outside air into the compression cylinder 2. When the compression piston 3 passes the bottom dead center. and reverses to the top dead center, the air within the compression cylinder 2 is pressurized, thereby automatically closing the intake valve 4 and compressing the air which has been taken into the compression cylinder 2. At this time, the air within the compression cylinder 2 becomes a high-temperature compressed air. Then, in the compressor 1, the compression piston 3 reaches the vicinity of the top dead center and the air within the compression cylinder 2 reaches a predetermined compressed air pressure, so that the discharge valve 7 is pushed open by the pressure, thereby discharging the compressed air to the pipe 6.

The high-temperature compressed air is sent to the first heat exchanger 5 through the pipe 6. As described above, the first heat exchanger 5 provides primary cooling so as to cool the high-temperature compressed air to about room temperature through heat exchange with the cooling water. The cooled compressed air is sent to the expander 22 through the pipe 21.

In the expander 22, the expansion piston 24 reciprocates between the top dead center and the bottom dead center, thereby adiabatically expanding the compressed air which has been led in from the heat exchanger 5 and sending it to the discharge tube 26. Specifically, only during the short period of time when the expansion piston 24 starts reversing to the bottom dead center after it is moved by the cam 37 past the top dead center, the expander 22 opens the intake value 25 to take the compressed air into the expansion cylinder 23. In phase during which the expansion piston 24 moves to the bottom dead center, the compressed air is adiabatically expanded within the expansion cylinder 23 to about the atmospheric pressure. Upon the adiabatic expansion, the temperature of the air within the expansion cylinder 23 decreases and the air becomes a cold air having a temperature on the order of minus several ten degrees. Then, while the expansion piston 24 reverses to the top dead center after it is moved by the cam 38 past the bottom dead center, the expander 22 opens the discharge valve 27 so as to discharge the cold air within the expansion cylinder 23 to the discharge tube 26.

Then, the cold air which has been subjected to the secondary cooling by the expander 22 of each cooling unit is sent from the discharge tube 26 to the manifold 70 so that the air flows are merged into a single flow and then absorbs heat from, and freezes, an object to be frozen. In the cooling device, the cold air flows from the three cooling units having a phase difference with respect to one another are gathered into a single flow, thereby synthesizing together the pulsations of the generated cold air flows from the respective cooling units, so that the discharged cold air after the synthesis has substantially no pulsation., The discharged cold air is discharged into a cold air discharge space 71 and is eventually expanded to the air pressure of the cold air discharge space 71. Thus, since the compressed air taken into the expansion cylinder 23 is adiabatically expanded to the air pressure of the cold air discharge space 71, the temperature of the discharged cold air is determined by the temperature and the pressure of the compressed air taken into the expansion cylinder 23. In the cooling unit as described above, the compressed air is cooled by the first heat exchanger 5 to about room temperature. Therefore, a colder air is obtained by increasing the pressure of the compressed air, and the temperature of the cold air increases by reducing the pressure of the compressed air.

As illustrated in FIG. 3, an arrangement for adjusting the temperature of the cold air may be obtained by, for example, providing a temperature sensor 94 in the cold air discharge manifold 70 and providing an air pressure measuring sensor 95 in the pipe 21 so that the air pressure within the pipe 21 is adjusted based on the temperature sensor 94 and the air pressure measuring sensor 95 so as to obtain a required cold air. An arrangement for adjusting the air pressure within the pipe 21 may be obtained by, for example, providing a depressurizing device 93 in the pipe 21, and a pressurizing device (not shown) such as, for example, a compressor in the pipe 6 or 21 so as to supply a compressed air.

For example, the depressurizing device depressurizes 93 and adjusts the pressure of the compressed air to be sent to the expansion cylinder 23 by discharging air to the outside when the air pressure within the pipe 21 is greater than a predetermined pressure. For example, the pressurizing device supplies a compressed air into the pipe 6 through a pipe 92, the compressed air being produced by the pressurizing compressor which is driven as necessary, thereby pressurizing and adjusting the pressure of the air within the pipe 6. The pressurizing compressor may be a compressor which is driven with a clutch mechanism whose engagement with the crank shaft 13 of the above-described cooling unit can be turned ON/OFF as necessary or a compressor which is driven by a separately driven motor as necessary. When the pressurizing compressor is coupled to the crank shaft 13 via a clutch mechanism as described above, the expansion energy of the expander 22 can be used. This is more economical as compared to a case where a separate and independent motor is used as a driving source, and is capable of taking more thermal energy away from the compressed air within the expansion cylinder 23, whereby it is possible to produce a cold air of a lower temperature.

Moreover, in the cooling device, the force experienced by the expansion piston 24 when adiabatically expanding the compressed air in the expander 22 assists the compression stroke of the compression piston 3 of the compressor 1. Specifically, in each cooling unit, the compression piston 3 and the expansion piston 24 are operated by the same crank shaft 13, whereby the expansion energy from the compressed air experienced by the expansion piston 24 can be used as a part of the compression energy of the compression piston 3, thereby reducing the load on the driving motor 10 for supplying the driving energy.

Moreover, in the cooling unit, the compression cylinder 2 and the expansion cylinder 23 are arranged along the same cylinder axis line L, and the piston rod 8 of the compression piston 3 and the piston rod 39 of the expansion piston 24 are coupled together along the cylinder axis line L, whereby when the expansion piston 24 moves from the top dead center to the bottom dead center, the expansion energy from the compressed air acts to push the expansion piston 24. Thus, the cooling unit has a higher energy efficiency and is more economical because the expansion energy from the compressed air can be converted directly into a compression energy which can be used by the compression piston 3 for compressing the outside air.

Moreover, the compressed air within the expansion cylinder 23 performs work for the compression by the compressor 1, thereby taking more thermal energy away. Thus, the cooling unit is capable of producing a cold air of a lower temperature.

Incidentally, the cold air which has been adiabatically expanded within the expansion cylinder 23 is further adiabatically expanded to the pressure of the cold air discharge space into which the air is discharged. Therefore, the cooling unit can provide a cold air of a lower temperature as the pressure of the compressed air taken into the expansion cylinder 23 is higher. On the other hand, a greater expansion energy can be obtained from the expander 22 as the pressure of the compressed air taken into the expansion cylinder is higher. Therefore, in the cooling unit, the load on the motor 10 is not significantly increased even when setting the temperature of the produced cold air to a low temperature.

The cooling device as described above is capable of producing a cold air of about minus 70° C. It is contemplated that the cooling device can be used for the air conditioning in a freezing storage or for the cooling of a cutting part of a machine tool, for example. Where it is used for a machine tool, the cooled air is sent to the cutting blade so as to absorb a frictional heat from cutting. As a result, it is possible to suppress the amount of cutting oil used to as much as it is necessary for lubrication. Moreover, by using, for example, a plant oil which can be easily degraded as the cutting oil, it is possible to produce an environment-friendly machine tool.

The cooling device according to the first embodiment of the present invention has been described above. While the cooling device includes three cooling units which are operated with a predetermined phase difference with respect to one another in order to suppress the pulsation of the cold air, the single cooling unit alone also has a function as a cooling device.

Next, another embodiment of the present invention will be described.

Figure 8:
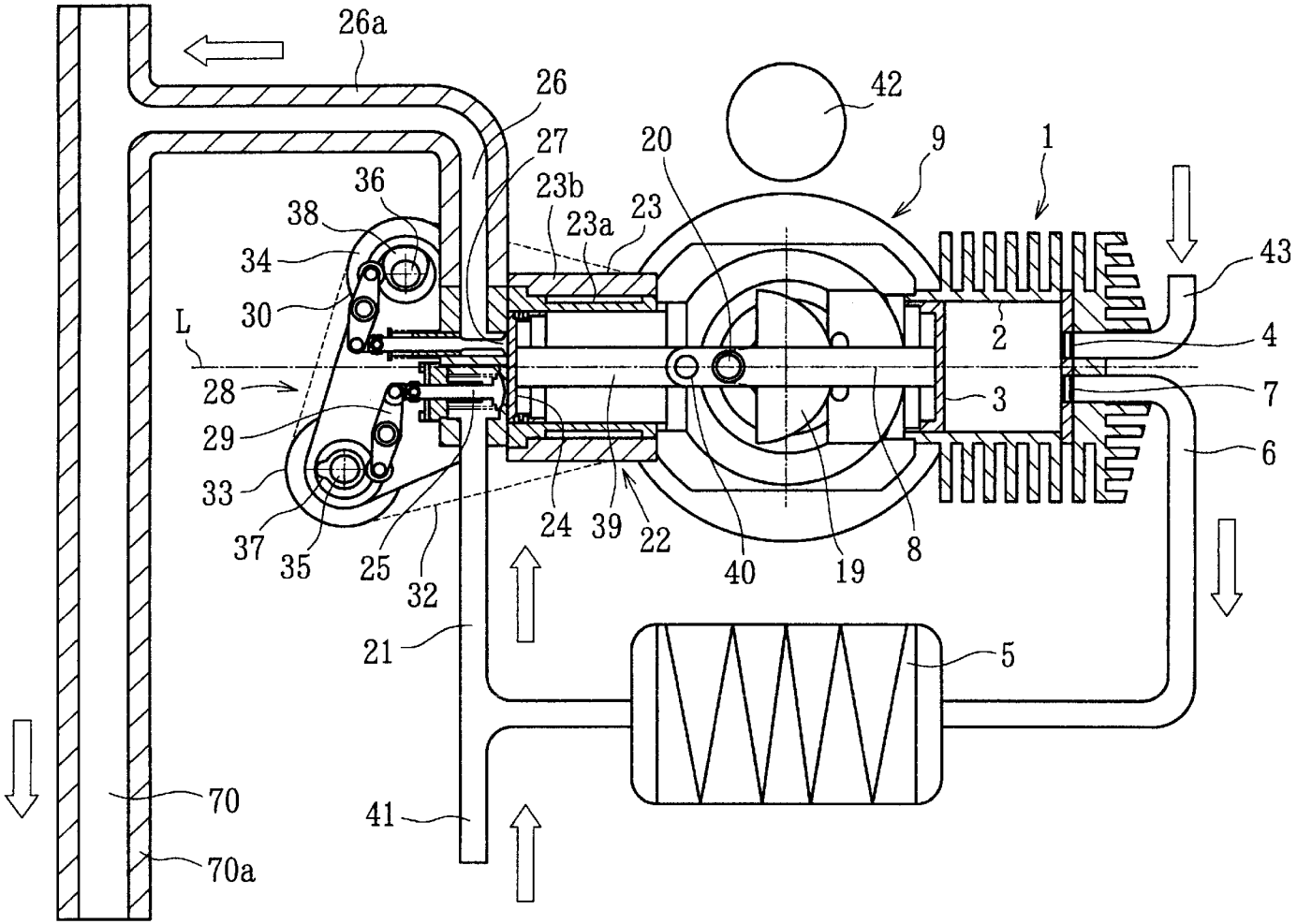
FIG. 8 is a longitudinal-sectional view illustrating an important part of a single cooling unit according to a second embodiment of the present invention.

FIG. 8 illustrates a cooling device according to the second embodiment of the present invention. The cooling device is similar to the above-described cooling device illustrated in FIG. 1 and FIG. 2 in terms of the general structure, but each cooling unit is driven by using external compressed air.

In the cooling unit of the second embodiment, an introduction tube 41 for introducing the external compressed air from external compressed air supply means (e.g., a compressor (not shown) which is operated by a separate driving source) is connected to an intermediate position along the pipe 21, and the crank shaft 13 of the crank device 9 is coupled to a cell motor 42 as a start-up driving device. Other than this, the structure is similar to that of the embodiment illustrated in FIG. 3 and FIG. 4.

In the cooling unit of the second embodiment, the cell motor 42 is operated at start-up, and the external compressed air is introduced from the introduction tube 41 into the pipe 21. At start-up, the cell motor 42 reciprocates the compression piston 3 of the compressor 1 via the crank device 9 between the top dead center and the bottom dead center. The external compressed air is introduced into the expansion cylinder 23 of the expander 22 through the pipe 21, thereby pushing the expansion piston 24 and operating the cooling unit. In the cooling device, once the system has started operating, the cell motor 42 can be stopped, because the expansion piston 24 of the expander 22 is already reciprocating continuously at a high speed, whereby the cooling device can be driven solely by the external compressed air based on the momentum.

According to the present embodiment, the compressor 1 and the expander 22 are driven in an interlocked manner by a single driving source of the external compressed air which is provided from an external compressor (not shown), and the adiabatic expansion energy of the expander 22 is effectively used as the compression energy for the compressor 1, whereby the cooling device operates in an economical manner.

In FIG. 8, the introduction tube 41 is connected to the pipe 21 which is downstream of the first heat exchanger 5. Alternatively, similar effects can be obtained when the external compressed air is introduced by connecting the introduction tube 41 to the pipe 6 which is upstream of the first heat exchanger 5.

Figure 9:
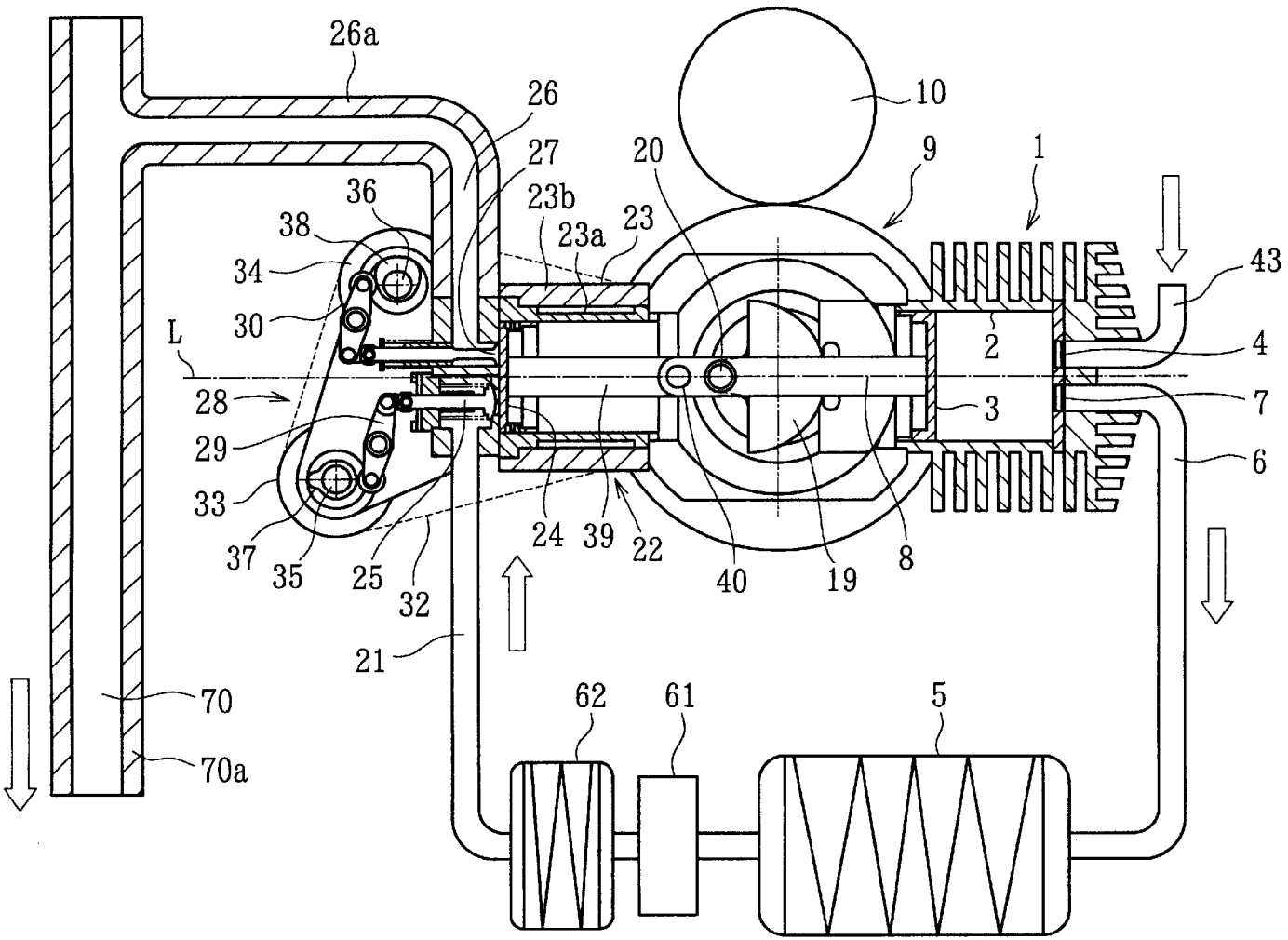
FIG. 9 is a longitudinal-sectional view illustrating an important part of a single cooling unit according to a third embodiment of the present invention.

Next, a cooling device according to the third embodiment of the present invention which is illustrated in FIG. 9 will be described.

The cooling device is similar to the cooling device of the first embodiment as described above except that an air dryer 61 as a device for drying air and a second heat exchanger 62 are provided along the pipe 21 of the cooling unit between the first cooler 5 and the expander 22.

The air dryer 61 is provided with a filter using, for example, a silica gel or an activated alumina as an adsorbent, so as to dry the air by chemically reacting the water vapor in the air within the filter to adsorb and remove the water vapor.

With such an air dryer 61, an adsorption heat is generated during the adsorption reaction. The second heat exchanger 62 is provided along the pipe 21 between the air dryer 61 and the expander 22. The second heat exchanger 62 has a structure similar to that of the first heat exchanger 5. The second heat exchanger 62 effectuates a heat exchange between the cooling water and the air pipe and radiates the adsorption heat of the air dryer 61 so as to further reduce the temperature of the compressed air to be taken into the expansion cylinder 23.

In this case, it is possible to remove the moisture contained in the air before sending the air to the expansion cylinder 23, whereby it is possible to eliminate the dew formation or icing within the expansion cylinder 23 or the cold air discharge manifold 70 which hampers the operation of the cooling device.

The air dryer 61 may alternatively be provided along the introduction pipe 43 for introducing air into the compressor 1 or along the pipe 6 between the compressor 1 and the first heat exchanger 5. In this case, the first heat exchanger 5 can cool the air which has passed through the air dryer, thereby eliminating the need for providing the second heat exchanger 62.

Figure 10:
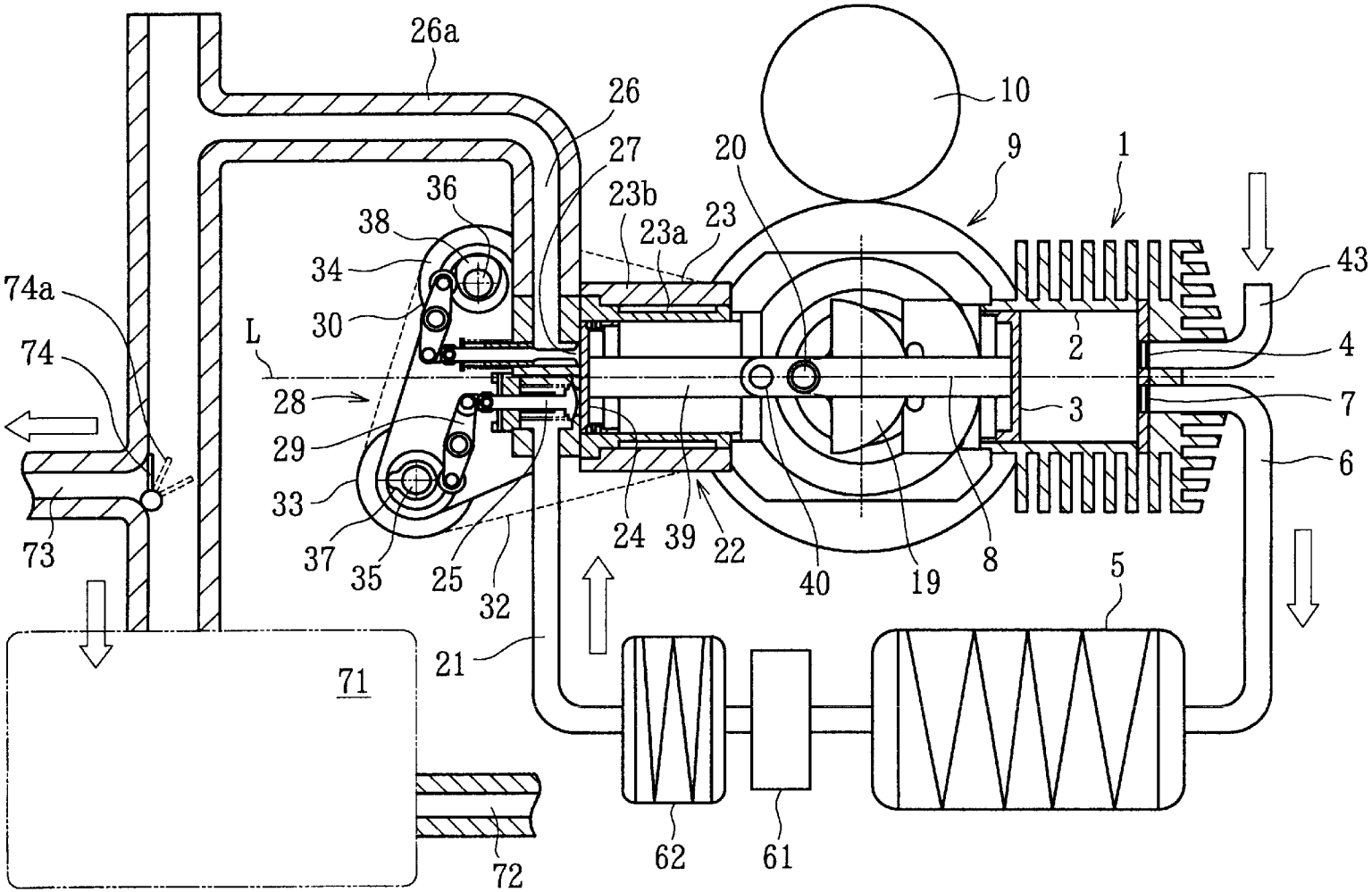
FIG. 10 is a longitudinal-sectional view illustrating an important part of a single cooling unit according to a fourth embodiment of the present invention.

Next, a cooling device according to the fourth embodiment of the present invention which is illustrated in FIG. 10 will be described.

The cooling device is similar to the cooling device of the third embodiment as described above except that a first introduction pipe 72 and a second introduction pipe 73 are provided. The first introduction pipe 72 is communicated to the introduction pipe 43 from the cold air discharge space 71 into which the cold air discharge manifold 70 is opened, so as to introduce the air from the cold air discharge space 71 into the compression cylinder 2. The second introduction pipe 73 takes a portion of the cold air from the cold air discharge manifold 70 and introduces it into the compression cylinder 2.

In the first introduction pipe 72, an introduction port 72*a* is provided, for example, in a closed space as the cold air discharge space 71, e.g., a freezing storage, to which the cooling device is attached, or in the vicinity of a cold air discharge port, which is opened toward a cutting portion of a tool. The air introduced through such an introduction port is colder and drier air than the normal outside air. Therefore, by re-introducing the air into the cooling device, the amount of moisture in the air which is to be removed by the air dryer 61 is reduced, thereby reducing the load on the air dryer 61, and the adsorption heat generated by the air dryer 61 is also reduced, thus reducing the load on the second heat exchanger 62 or the first heat exchanger 5.

The second introduction pipe 73 is a pipe coupling the cold air discharge manifold 70 and the introduction pipe 43 of the compression cylinder 2. The coupling section to the cold air discharge manifold 70 is provided with a three-way valve 74. The second introduction pipe 73 is for re-introducing into the compression cylinder 2 excessive cold air which is produced when more than necessary cold air is produced in the cooling device, e.g., when the pressure within the cold air discharge manifold 70 is higher than a predetermined pressure or when the temperature of the cold air discharge space 71 such as a cooling storage has become less than or equal to a predetermined temperature. Since the air introduced through the second introduction pipe 73 is a dry cold air, it is possible to introduce into the compression cylinder 2 air which is colder and drier as compared to ordinary outside air. Thus, it is possible to reduce the load on the first heat exchanger 5, the air dryer 61, etc.

A broken line 74*a* in FIG. 10 illustrates an embodiment where the three-way valve is always half-open. In this embodiment, the second introduction pipe 73 may be communicated to the introduction pipe 43 after passing it through the cooling water for the first heat exchanger 5 and/or the second heat exchanger 62 so that a portion of the produced cold air is introduced into the compression cylinder after it is used for cooling the cooling water.

The above-described embodiments merely represent preferred, particular examples of the present invention, which is therefore not limited to these embodiments, and various design changes can be made thereto within the scope of the technical concept.

Moreover, while each of the above-described embodiments employs a crank device provided with a planetary gear mechanism, the present invention is not limited to such a crank device. For example, even when the crank shaft of the crank device to be provided for the compression cylinder and the crank shaft of the crank device to be provided for the expansion cylinder are arranged separately, the expansion energy in the expander can be effectively used as the compression energy in the compressor as long as the respective crank shafts are interlocked together via power transmission means such as a belt or a coupling.

Figure 19:
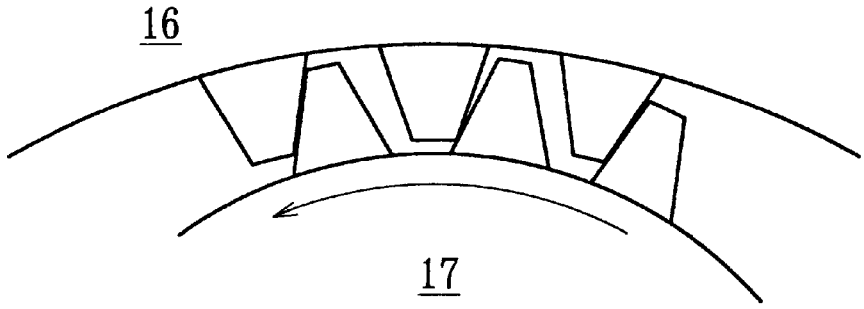
FIG. 19(A) is a diagram illustrating the tooth contact of a planetary gear mechanism of a crank device which is driven by a motor.
FIG. 19(B) is a diagram illustrating the tooth contact of a planetary gear mechanism of a crank device which is driven by an expansion energy.
Figure 19:
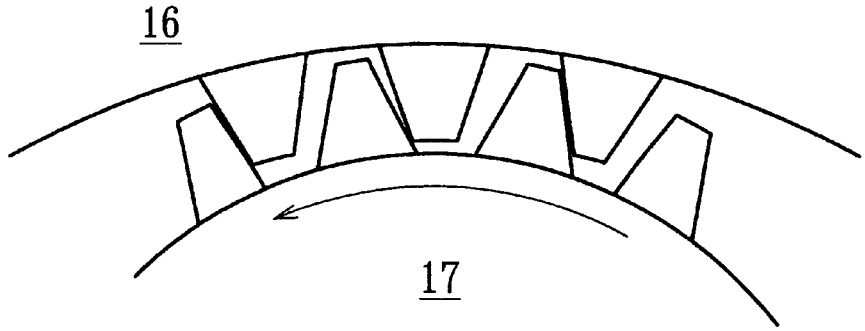

In the planetary gear mechanism 15 of the crank device 9 of the cooling unit as described above, the crank shaft 13 and the planetary gear 17 are rolled by the motor 10 while the expansion piston 24 of the expansion cylinder 23 is moving from the bottom dead center to the top dead center. Therefore, as illustrated in FIG. 19(A), the planetary gear 17 may possibly be revolving with its teeth being in contact with others on the front side with respect to its rotation direction A. On the other hand, while the expansion piston 24 of the expansion cylinder 23 is moving from the top dead center to the bottom dead center, the expansion piston 24, the piston rod 39, etc., are pressed by the compressed air toward the compressor 1, whereby the planetary gear 17 is always biased toward the compressor 1 so that it revolves with its teeth being in contact with others on the rear side with respect to its rotation direction A, as illustrated in FIG. 19(B).

Thus, when the compressed air is taken into the expansion cylinder 23 at the top dead center of the expansion piston 24, the tooth contact of the planetary gear 17 changes from a tooth contact on the front side with respect to its rotation direction to a tooth contact on the rear side, whereupon large tooth noise may be generated.

Other cooling devices according to the fifth embodiment to the seventh embodiment which solve the tooth sound problem as described above will now be described with reference to the figures.

Figure 11:
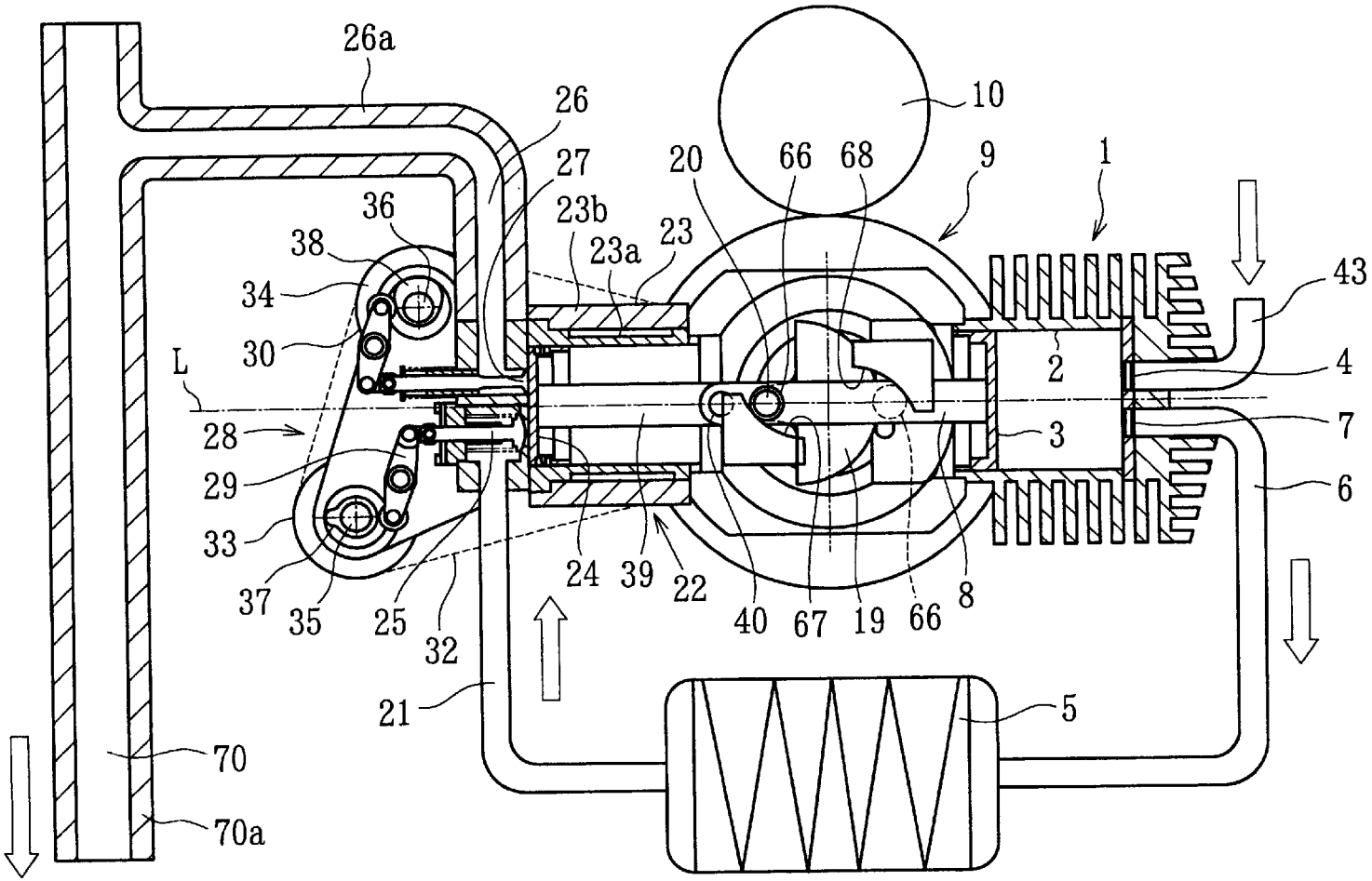
FIG. 11 is a longitudinal-sectional view illustrating an important part of a cooling device according to a fifth embodiment of the present invention.
Figure 12:
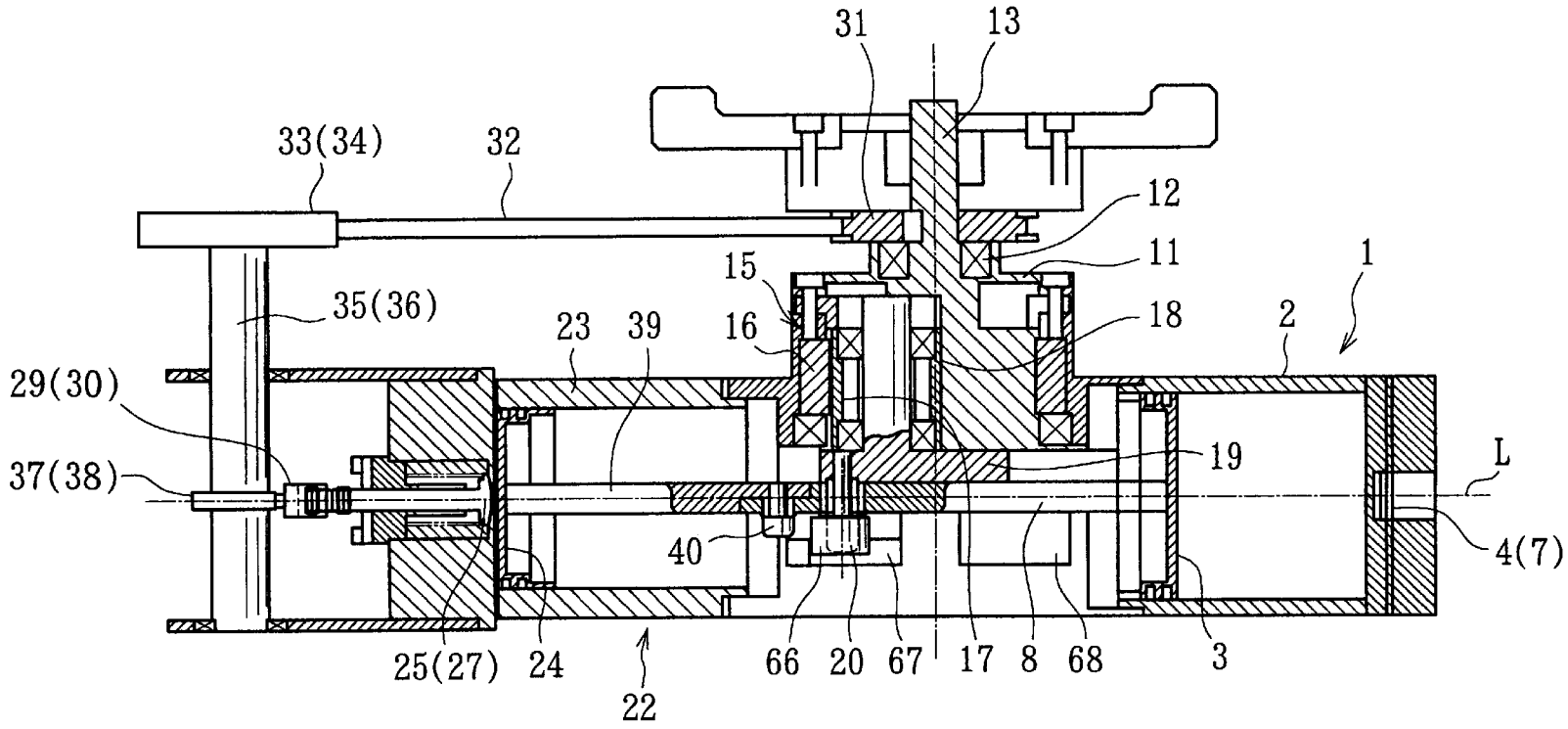
FIG. 12 is a cross-sectional view illustrating an important part of FIG. 5.

The fifth embodiment provides a single cooling unit which includes the compressor 1, the pipes .(6, 21) as compressed air supply passages, the first heat exchanger 5 as a primary cooler, the expander 22, the discharge tube 26, the piston rods (8, 39), the crank device 9, a cam mechanism 65, and the driving motor 10 as a driving device, as illustrated in FIG. 11 and FIG. 12.

The compressor 1, the first heat exchanger 5, the expander 22, the discharge tube 26, the piston rods (8, 39) and the crank device 9 have respective structures as those of the first embodiment, and therefore will not be further described below to avoid redundancy.

Figure 13:
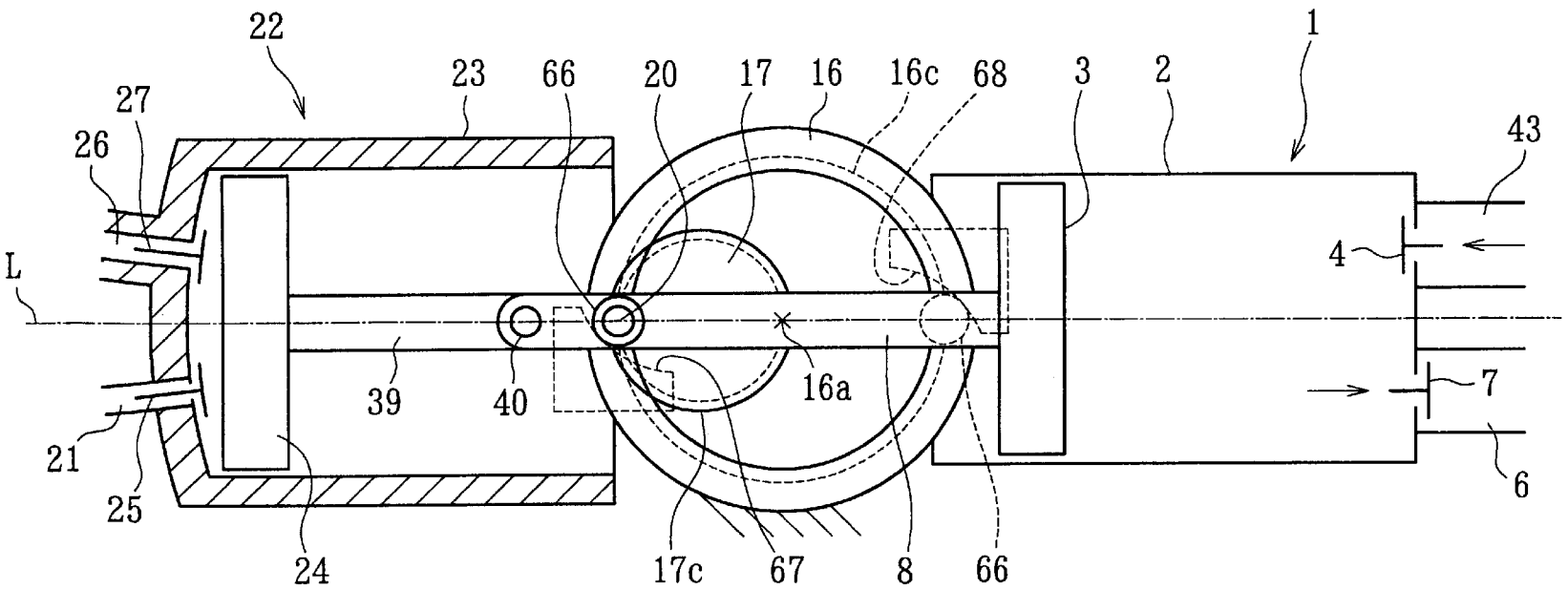
FIG. 13 is a schematic diagram illustrating a crank device according to the fifth embodiment of the present invention.
Figure 14:
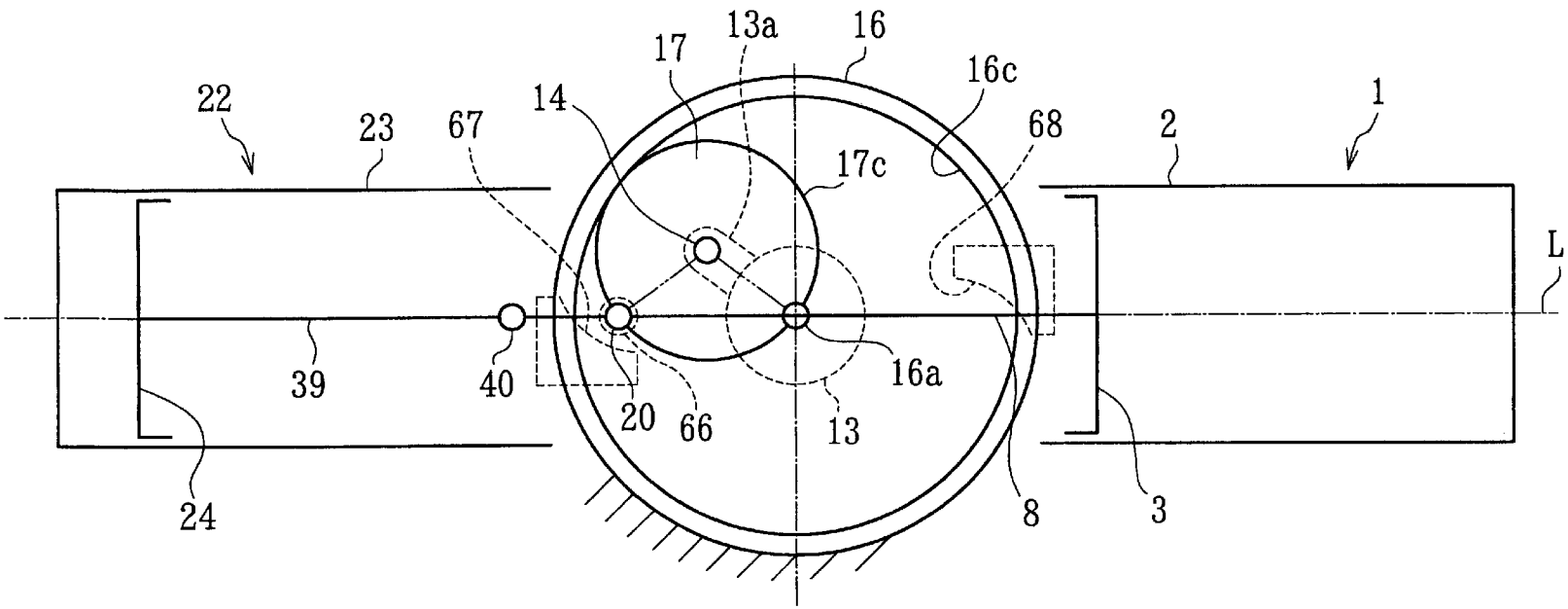
FIG. 14 is a schematic diagram illustrating the crank device according to the fifth embodiment of the present invention.
Figure 15:
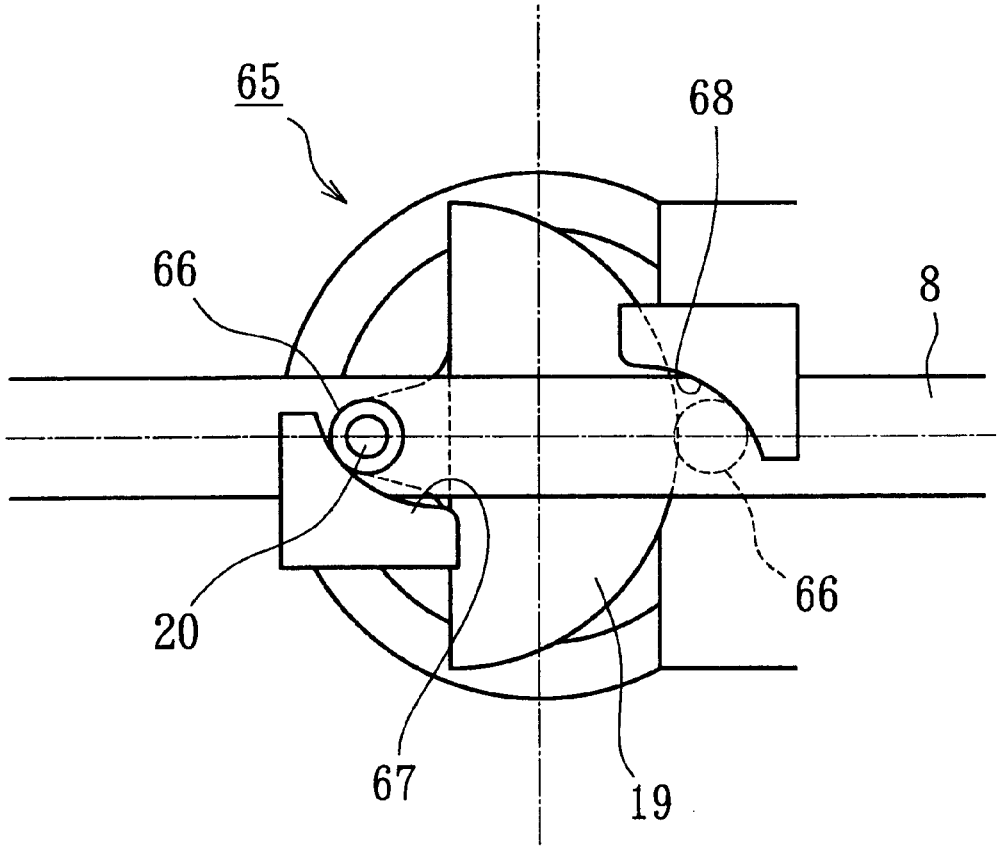
FIG. 15 is a diagram illustrating a cam mechanism of the cooling device according to the fifth embodiment of the present invention.

As illustrated in FIG. 13 to FIG. 15, the cam mechanism 65 includes a cam follower 66 and cam guide surfaces (67, 68) which are set so as to guide the cam follower 66 along a predetermined path.

The cam follower 66 is provided by attaching a bearing, for example, on an end portion of the coupling pin 20 of the crank device 9 on the side of the piston rod 8.

The cam guide surface 67 guides the cam follower 66 so that the planetary gear 17 revolves around the sun gear 16 with the tooth contact being made on the rear side with respect to its rotation direction before the expansion piston 24 of the expansion cylinder 23 reaches the top dead center. In this embodiment, the planetary gear 17 revolves clockwise along the inner periphery of the sun gear 16 as illustrated in the figures. Accordingly, as the expansion piston 24 of the expansion cylinder 23 comes closer to the top dead center, the cam guide surface 67 guides the cam follower 66 gradually toward a position which is shifted upward from the cylinder axis line L by a distance corresponding to the gear's backlash. Therefore, the planetary gear 17 has its tooth contact on the rear side with respect to its rotation direction before the expansion piston 24 of the expansion cylinder 23 reaches the top dead center.

Thus, in the cooling device of the fifth embodiment, the planetary gear 17 has its tooth contact on the rear side with respect to its rotation direction before the expansion piston 24 reaches the top dead center, by the action of the cam mechanism 65, whereby it is possible to eliminate the large tooth sound which may occur from the reversion of the tooth contact.

The cam guide surface 68 guides the cam follower 66 so that the planetary gear 17 revolves around the sun gear 16 with the tooth contact being made on the front side with respect to its rotation direction before the expansion piston 24 of the expansion cylinder 23 reaches the bottom dead center. In this embodiment, the planetary gear 17 revolves clockwise along the inner periphery of the sun gear 16 as illustrated in the figures. Accordingly, as the expansion piston 24 of the expansion cylinder 23 comes closer to the bottom dead center, the cam guide surface 68 guides the cam follower 66 gradually toward a position which is shifted downward from the cylinder axis line L by a distance corresponding to the gear's backlash. Therefore, the planetary gear 17 has its tooth contact on the front side with respect to its rotation direction before the expansion piston 24 of the expansion cylinder 23 reaches the bottom dead center.

Thus, in the cooling device of the fifth embodiment, the planetary gear 17 has its tooth contact on the front side with respect to its rotation direction before the expansion piston 24 reaches the bottom dead center, by the action of the cam mechanism 65, whereby it is possible to provide the rolling by smoothly receiving the driving force from the motor 10 and to eliminate the large tooth sound which may occur from the reversion of the tooth contact.

The tooth sound of the planetary gear 17 is particularly large when taking the compressed air into the expansion cylinder 23. To eliminate only such a tooth sound, the cam guide surface 68 may be omitted while providing only the cam guide surface 67 in the cam mechanism 65.

Figure 16:
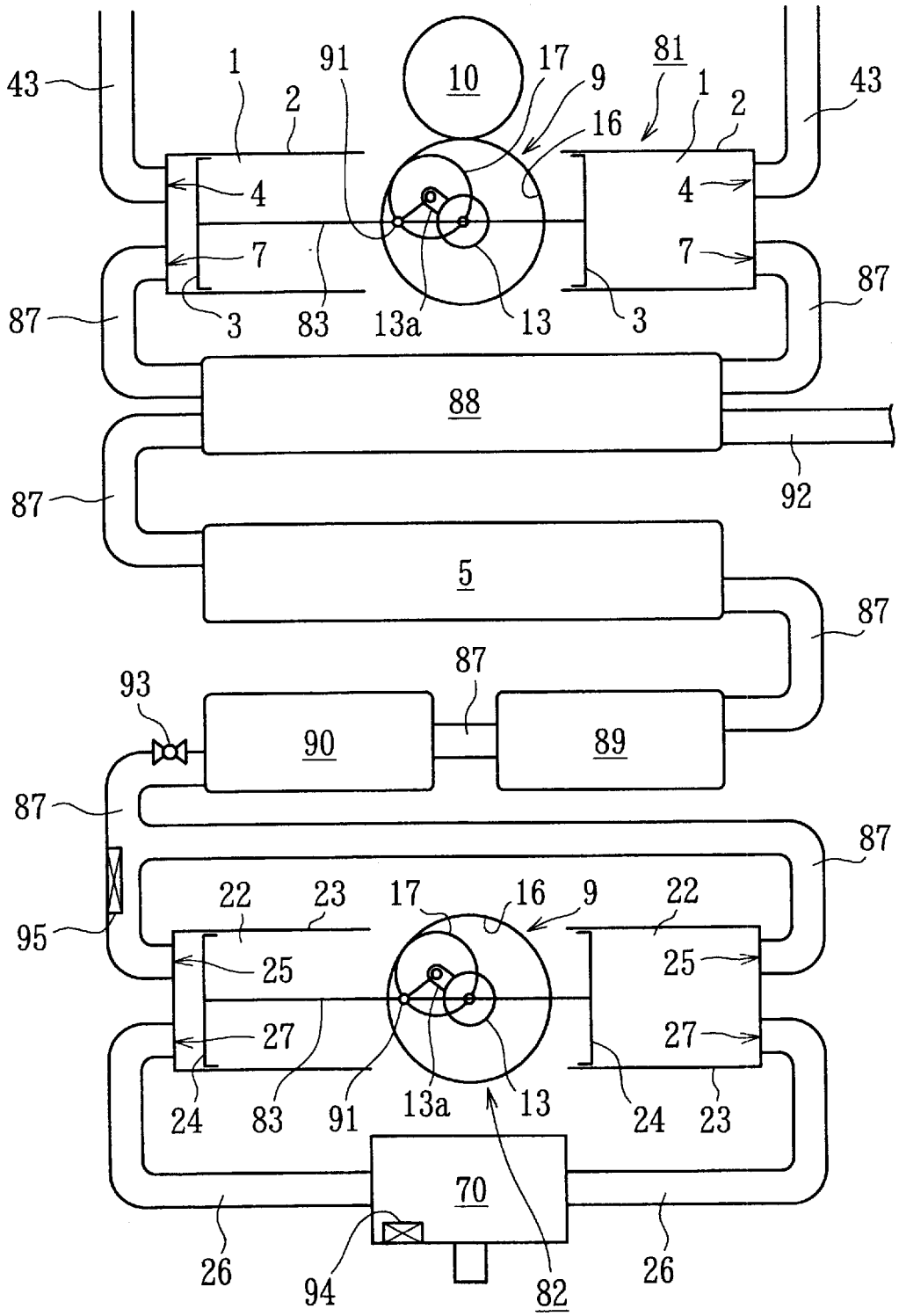
FIG. 16 is a diagram illustrating the general structure of a cooling device according to a sixth embodiment and a seventh embodiment of the present invention.
Figure 17:
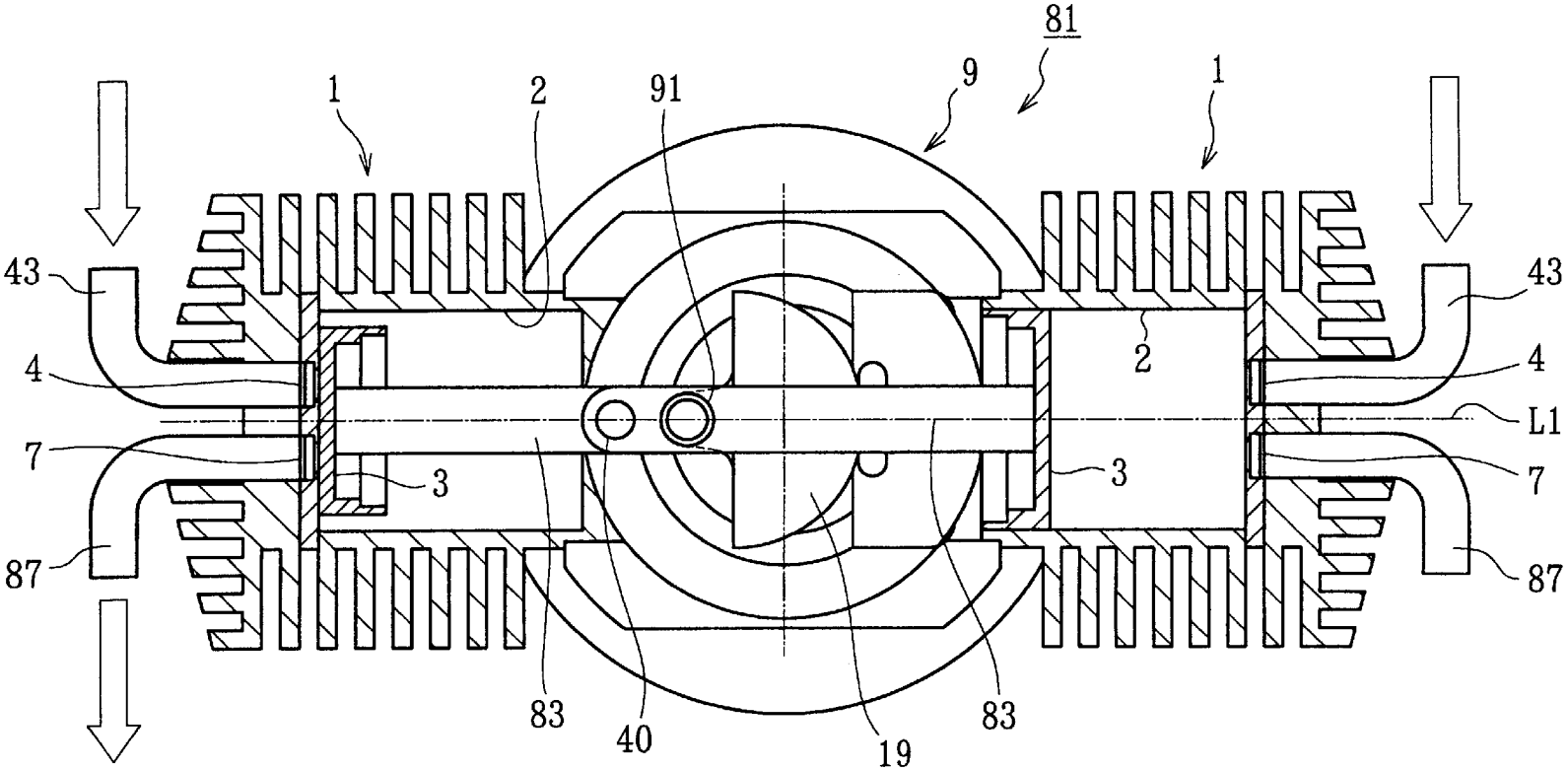
FIG. 17 is a longitudinal-sectional view illustrating an important part of the structure of a compression cylinder unit according to the sixth embodiment of the present invention.
Figure 18:
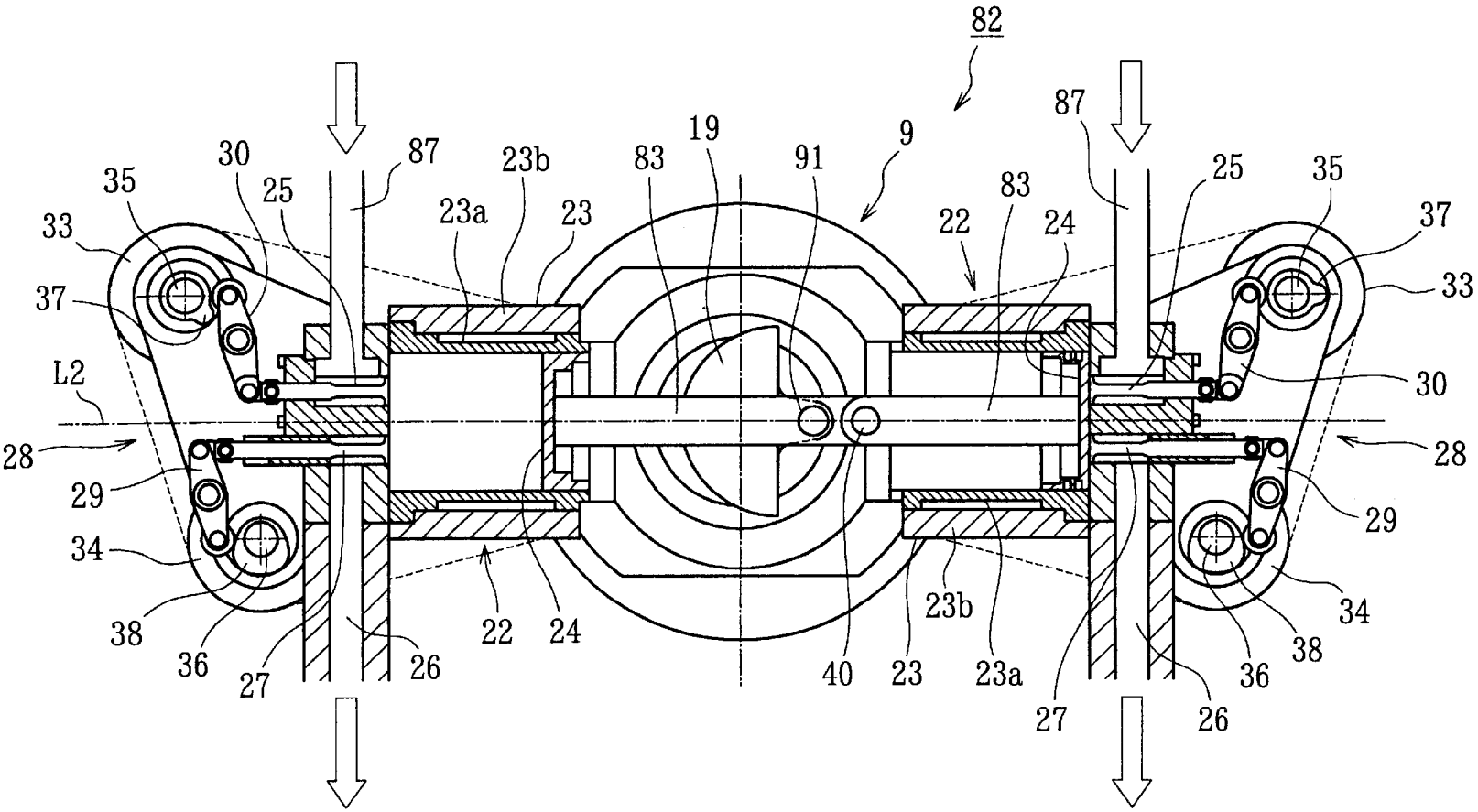
FIG. 18 is a longitudinal-sectional view illustrating an important part of the structure of a compression cylinder unit according to the sixth embodiment of the present invention.

Next, a cooling device according to the sixth embodiment of the present invention which is illustrated in FIG. 16, FIG. 17 and FIG. 18 will be described.

As illustrated in FIG. 16, the cooling device includes a compression cylinder unit 81, an expansion cylinder unit 82, a piston rod 83, the crank device 9, the motor 10 as a driving device, a pipe 87 as a compressed air supply passage, the primary heat exchanger 5 as a primary cooler, an air dryer 89, a secondary heat exchanger 90, and the cold air discharge manifold 70. In FIG. 16, FIG. 17 and FIG. 18, those elements having structures as those of the cooling device according to the first embodiment described above will be provided with the same reference numerals, and therefore will not be further described to avoid redundancy.

As illustrated in FIG. 17, the compression cylinder unit 81 includes two compression cylinders 2 which are provided along the same cylinder axis line L1 so as to oppose each other with their cylinder heads facing away from each other, wherein the compression pistons 3 accommodated in the respective compression cylinders 2 to allow reciprocating motion thereof are pivotally coupled to the piston rod 83 so that the compression pistons 3 reciprocate with the same cycle and with a 180° phase difference with respect to each other.

Each of the compression cylinders 2 is similar to the compression cylinder 2 of the compressor 1 of the first embodiment, and includes the intake valve 4 and the discharge valve 7 provided in its cylinder head for taking in the outside air and discharging the compressed air.

As illustrated in FIG. 18, the expansion cylinder unit 82 includes two expansion cylinders 23 which are provided along the same cylinder axis line L2 so as to oppose each other with their cylinder heads facing away from each other, wherein the expansion pistons 24 accommodated in the respective expansion cylinders 23 to allow reciprocating motion thereof are pivotally coupled to the piston rod 83 so that the expansion pistons 24 reciprocate with the same cycle and with a 180° phase difference with respect to each other.

Each of the expansion cylinders 23 is similar to the expansion cylinder 23 of the expander 22 of the first embodiment, and includes the intake valve 25, the discharge valve 27 and the valve operating mechanism 28 provided in its cylinder head for taking the compressed air into the expansion cylinder 23, adiabatically expanding the compressed air and discharging the cold air at a predetermined timing. Each expansion cylinder 23 is an adiabatic cylinder which ensures thermal insulation of the air when expanded, wherein each discharge tube 26 is covered with a thermal insulator 26*a* in order to ensure thermal insulation of the cold air which is discharged from the expander 22.

While the piston rods 83 may be provided as a single 25 piston rod, two piston rods are coupled together by the pin 40 to be a foldable piston rod.

As in the crank device 9 of the first embodiment, the crank device 9 includes the planetary gear mechanism 15 so as to reciprocate a coupling pin 91 coupled to the piston rods 83 of the cylinder units (81, 82) along the cylinder axis line.

The motor 10 serves as a driving source for rotating the crank shaft 13 of the compression cylinder unit 81. The crank shaft 13 of the compression cylinder unit 81 and the crank shaft 13 of the expansion cylinder unit 82 are coupled together by a belt, a coupling, etc., as power transmission means so as to be interlocked with each other.

The high-temperature compressed air flows discharged from the respective compression cylinders 2 of the compression cylinder unit 81 are gathered into a compressed air collection manifold 88 through the pipes 87, and then taken into the expansion cylinder unit 82 after passing through the first heat exchanger 5, the air dryer 89 and the second heat exchanger 90 in this order.

The first heat exchanger 5 is similar to the first heat exchanger 5 of the first embodiment as described above, and provides primary cooling so as to cool the compressed air to about room temperature. The air dryer 89 is provided with a filter using, for example, a silica gel or an activated alumina as an adsorbent, so as to dry the air by chemically reacting the water vapor in the air within the filter to adsorb and remove the water vapor. The second heat exchanger 90 has a structure as that of the first heat exchanger 5 for removing the adsorption heat generated by the air dryer 89 to further reduce the temperature of the compressed air to be taken into the expansion cylinder 23.

The expansion cylinder 23 opens the intake value 25 only during a short period of time when the expansion piston 24 is moved past the top dead center and starts reversing to the bottom dead center so as to take the compressed air into the expansion cylinder 23. The expansion cylinder 23 produces a cold air by adiabatically expanding the compressed air within the expansion cylinder 23 to about the atmospheric pressure while the expansion piston 24 is moving to the bottom dead center, and discharges the cold air by opening the discharge valve 27 while the expansion piston 24 is moving from the bottom dead center to the top dead center. The cold air flows discharged from the expansion cylinder unit 82 are gathered together in the cold air discharge manifold 70 so as to be used for cooling of an object.

The crank shafts 13 of the respective crank devices 9 of the compression cylinder unit 81 and the expansion cylinder unit 82 are coupled together by a belt, a coupling, etc., so as to be interlocked with each other, whereby the expansion energy is transmitted from the crank shaft 13 of the expansion cylinder unit 82 to the crank shaft 13 of the compression cylinder unit 81. This reduces the load on the motor 10 and is economical, while the expansion energy can be used as the compression energy in the compression cylinder unit 81. Thus, the cooling device is capable of taking much thermal energy away from the compressed air within the expansion cylinder 23, whereby it is possible to produce a cold air of a lower temperature.

In this embodiment, the crank device 9 of the compression cylinder unit 81 is always rotated mainly by the motor 10, and the planetary gear 17 revolves with the tooth contact being made on the front side with respect to its rotation direction, whereby there is no large tooth sound which occurs from the reversion of the tooth contact. Moreover, the crank device 9 of the expansion cylinder unit 82 is always rotated by obtaining an expansion energy from either one of the expansion pistons 24, and the planetary gear 17 revolves with the tooth contact being made on the rear side with respect to its rotation direction, whereby there is no large tooth sound which occurs from the reversion of the tooth contact.

Next, the seventh embodiment of the present invention will be described with reference to FIG. 16.

The basic structure of this embodiment is the same as that of the cooling device of the sixth embodiment.

A pipe 92 in FIG. 16 passes therethrough a high-temperature compressed air which is discharged from a pressurizing compression cylinder unit which is not shown.

The pressurizing compression cylinder unit is similar to the compression cylinder unit 81 of the sixth embodiment illustrated in FIG. 18, and is operated as necessary. As the driving source for the pressurizing compression cylinder unit, the pressurizing compression cylinder unit may be coupled to, for example, the crank shaft 13 of the crank device 9 of the expansion cylinder unit 82 via a clutch mechanism (not shown) by which power transmission can be turned ON/OFF, or the pressurizing compression cylinder unit may be operated by using a separate and independent motor (not shown) as a driving source.

When it is coupled to the crank shaft 13 of the crank device 9 of the expansion cylinder unit 82 via a clutch mechanism, the expansion energy from the expansion cylinder unit 82 can be used as described above. This is more economical as compared to a case where a separate and independent motor is used as a driving source, and is capable of taking more thermal energy away from the compressed air within the expansion cylinder 23, whereby it is possible to produce a cold air of a lower temperature.

The cooling device of the seventh embodiment is designed so that the pressurizing compression cylinder unit is operated when, for example, the pressure of the air within the compressed air collection manifold 88 at start-up is lower than a predetermined pressure, or when it is desired to further increase the pressure of the air within the compressed air collection manifold 88 in order to produce a cold air of a lower temperature.

Thus, it is possible to quickly bring the pressure of the compressed air to be taken into the expansion cylinder unit 82 to a predetermined pressure by operating the pressurizing compression cylinder unit at start-up, for example, whereby it is possible to shorten the period of time required to obtain a cold air of the required temperature. Moreover, by providing the air pressure measuring sensor 95 and the depressurizing device 93 along the pipe by which air is taken into the expansion cylinder unit 82 and by attaching the temperature sensor 94 within the cold air discharge manifold 70 for measuring the temperature of the produced cold air, it is possible to freely increase/decrease the pressure of the compressed air to be taken into the expansion cylinder unit 82, whereby it is possible to design the device so that the cold air of the required temperature can be obtained.

For example, a control device (not shown) may be used to provide a control such that the temperature sensor 94 senses the desired temperature by operating the pressurizing compression cylinder unit so as to increase the pressure of the compressed air to be taken into the expansion cylinder unit 82 which is sensed by the air pressure measuring sensor 95 when the temperature of the cold air sensed by the temperature sensor 94 is higher than the desired temperature (when it is desired to decrease the temperature of the produced cold air). Conversely, the control device (not shown) may be used to provide a control such that the temperature sensor 94 senses the desired temperature by operating the depressurizing device 93 so as to decrease the pressure of the compressed air to be taken into the expansion cylinder unit 82 which is sensed by the air pressure measuring sensor 95 when the temperature of the cold air sensed by the temperature sensor 94 is lower than the desired temperature (when it is desired to increase the temperature of the produced cold air).

As described above, according to the seventh embodiment, it is possible to easily perform the temperature control of the cold air, etc., which has been difficult in a case where the compression cylinder unit 81 and the expansion cylinder unit 82 are operated with the same cycle.

While an embodiment of the cooling device according to the present invention has been described above, the present invention is not limited to such an embodiment.

The effects of the present invention will be summarized below.

(1) In the cooling device of the present invention, the cold air flows produced from a plurality of cooling units which operate with a predetermined phase difference with respect to one another are gathered into a single flow and then discharged, thereby synthesizing together the pulsations of the generated cold air flows from the respective cooling units, so as to eliminate pulsation in the discharged cold air.

(2) Where the cooling device is driven by a start-up driving device provided in the crank shaft of the cooling unit and the supply of a driving external compressed air through the compressed air supply passage, the device can be driven only by the driving external compressed air, thereby improving the efficiency of the driving of the cooling unit.

(3) In the cooling device of the present invention, an air drying device is provided in the introduction passage through which air is introduced into the compression cylinder or the compressed air supply passage which communicates the discharge port of the compression cylinder with the intake port of the expansion cylinder. Therefore, it is possible to remove the moisture in the air before expanding the compressed air so as to prevent the dew formation or icing within the expansion cylinder, etc.

(4) In the cooling device of the present invention, an introduction pipe is provided for introducing air from a cold air discharge manifold or a cold air discharge space into the compression cylinder so as to obtain from these places a part of the air to be introduced into the compression cylinder. Therefore, it is possible to introduce air which is colder and drier than the normal outside air, thereby reducing the load on the air drying device or the heat exchanger.

(5) In the cooling device of the present invention, the crank devices of the respective cooling units are interlocked with one another by interlocking means, and one of the crank devices is provided with a large flywheel. Therefore, the operations of the other crank devices are led by and follow the operation of the crank device which is provided with the large flywheel in a synchronized manner with a predetermined phase difference with respect to one another, thereby reducing the cost as compared to a case where each crank device is provided with a flywheel.

(6) In the cooling device of the present invention, the expansion cylinder of the expander in the cooling unit is formed by an adiabatic cylinder having a good thermal insulation. Therefore, the adiabatic expansion in the expander is performed efficiently, thereby providing an economical advantage.

(7) In the cooling device of the present invention, if a crank device is provided with a planetary gear mechanism and the piston rods of each two cylinders are linearly coupled to each other, the slap of piston is unlikely to occur and the vibration, noise, cavitation, abrasion, etc., are significantly reduced. Moreover, the adiabatic expansion energy of the expander can be more effectively used as the compression energy of the compressor.

(8) In the cooling device of the present invention, a the compression cylinder and the expansion cylinder are provided along the same cylinder axis line, and the crank device having the planetary gear mechanism is provided so as to linearly reciprocate the piston rod, while the cam follower is provided at the pin engagement section between the planetary gear and the piston rod, with a cam mechanism in which the cam guide surface is set so that the planetary gear meshes with the sun gear on the rear side with respect to its rotation direction before the expansion piston reaches the top dead center. Therefore, when the compressed air is taken into the expansion cylinder, the planetary gear is already meshing with the sun gear on the rear side with respect to its rotation direction, thereby eliminating the large tooth sound which used to occur from the reversion of the tooth contact.

(9) In the cooling device where the above-described cam mechanism is provided with a cam guide surface which is set so that the planetary gear meshes with the sun gear on the front side with respect to its rotation direction before the expansion piston reaches the bottom dead center, the planetary gear meshes with the sun gear on the front side with respect to its rotation direction while the expansion cylinder is moving from the bottom dead center to the top dead center, whereby the device can be smoothly operated by a motor.

(10) The cooling device may include a compression cylinder unit including two compression cylinders accommodating therein compression pistons so as to allow reciprocating motion thereof which are provided along the same cylinder axis line with the respective cylinder heads facing away from each other, and an expansion cylinder unit including two expansion cylinders accommodating therein expansion pistons so as to allow reciprocating motion thereof which are provided along the same cylinder axis line with the respective cylinder heads facing away from each other, wherein a crank mechanism having a planetary gear mechanism is used so that each piston rod linearly reciprocates along the cylinder axis line. Then, the compression cylinder unit can be operated by a motor, and the expansion cylinder unit can be operated by the expansion energy of the compressed air, thereby eliminating the reversion of the tooth contact of the planetary gear in the crank mechanism and thus eliminating the large tooth sound.

(11) In the cooling device where a compressed air is supplied from a compressor which can be operated as necessary into the compressed air supply passage which communicates the discharge port of the compression cylinder with the intake port of the expansion cylinder, it is possible to increase the pressure of the compressed air before it is taken into the expansion cylinder by operating the compressor as necessary. Therefore, it is possible to adjust the temperature of the produced cold air with a cooling device in which the compression cylinder and the expansion cylinder are interlocked with each other.

(12) The cooling device includes a depressurizing device provided in the compressed air supply passage and a temperature sensor for measuring the temperature of the produced cold air, wherein the depressurizing device and the compressor are operated as necessary based on the temperature sensor so as to increase/decrease the pressure, of the air within the compressed air supply passage. Therefore, it is possible to design a cooling device in which the compression cylinder and the expansion cylinder are interlocked with each other so as to obtain a cold air of the desired temperature.

What is claimed is:

1. A cooling device, comprising: one or a plurality of compression cylinders each accommodating therein a compression piston so as to allow reciprocating motion thereof; a plurality of expansion cylinders each accommodating therein an expansion piston so as to allow reciprocating motion thereof; one crank shaft or a plurality of crank shafts rotating in an interlocked manner with the same cycle; a first crank mechanism for coupling the respective compression pistons so as to allow reciprocating motion thereof from the crank shaft via a crank pin; a second crank mechanism for coupling the respective expansion pistons so as to allow reciprocating motion thereof from the crank shaft via a crank pin with a predetermined phase difference with respect to one another; a driving device for rotating the respective crank shafts; a compressed air supply passage for communicating a discharge port of each compression cylinder with an intake port of each expansion cylinder, the discharge port being provided for discharging a compressed air which is introduced through an intake port of the compression cylinder and compressed within the compression cylinder; a primary cooler provided along the compressed air supply passage; and a cold air discharge manifold for communicating together a plurality of discharge ports for discharging the air whose temperature is reduced through adiabatic expansion within the respective expansion cylinders to the outside.

2. The cooling device according to claim 1, comprising, in place of the driving device, a start-up driving device for rotating the crank shaft at start-up, and a compressed air supply source for supplying a driving compressed air of a predetermined pressure into the compressed air supply passage.

3. A cooling device, comprising: one or a plurality of compression cylinders each accommodating therein a compression piston so as to allow reciprocating motion thereof; one or a plurality of expansion cylinders each accommodating therein an expansion piston so as to allow reciprocating motion thereof; one crank shaft or a plurality of crank shafts interlocked with one another; a first crank mechanism for coupling the respective compression pistons so as to allow reciprocating motion thereof from the crank shaft via a crank pin; a second crank mechanism for coupling the respective expansion pistons so as to allow reciprocating motion thereof from the crank shaft via a crank pin; a driving device for rotating the crank shaft; a compressed air supply passage for communicating a discharge port of each compression cylinder with an intake port of each expansion cylinder, the discharge port being provided for discharging a compressed air which is introduced through an intake port of the compression cylinder and compressed within the compression cylinder; a primary cooler provided along the compressed air supply passage; an air drying device provided in an intake passage for introducing air into the intake port of the compression cylinder or in the compressed air supply passage; and a cold air discharge manifold for communicating together a plurality of discharge ports for discharging the air whose temperature is reduced through adiabatic expansion within the respective expansion cylinders to the outside.

4. The cooling device according to claim 3, wherein a secondary cooler is provided between the air drying device and the compression cylinder in a case where the air drying device is provided along the compressed air supply passage on a side of the compression cylinder with respect to the primary cooler.

5. The cooling device according to claim 3 or 4, wherein an introduction pipe for introducing air into the intake port of the compression cylinder is opened into a cold air discharge space of the cold air discharge manifold so as to introduce the air discharged from the cold air discharge manifold into the compression cylinder.

6. The cooling device according to any of claims 1 to 4, wherein an introduction pipe for introducing air into the intake port of the compression cylinder is communicated with the cold air discharge manifold so as to introduce a part of the air within the cold air discharge manifold into the compression cylinder.

7. The cooling device according to any of claims 1 to 4, wherein a flywheel for ensuring a stable operation of the cooling device is provided for one of the crank shafts.

8. The cooling device according to any of claims 1 to 4, wherein the adiabatic cylinder is formed by inner and outer tubes layered together, the inner tube being made of a stainless steel.

9. The cooling device according to any of claims 1 to 4, wherein each two of the cylinders are provided along the same cylinder axis line so as to oppose each other with respective cylinder heads thereof facing away from each other, the cooling device comprising: a piston rod for coupling together respective pistons of the two cylinders and linearly reciprocating along the cylinder axis line; and a crank mechanism comprising an inner periphery sun gear in which a central axis of a pitch circle thereof orthogonally crosses the cylinder axis line between the two cylinders and which is fixedly provided in parallel to the cylinder axis line, a planetary gear having a pitch circle diameter which is one half of the pitch circle diameter of the inner periphery sun gear, the planetary gear being capable of rotating and revolving while meshing with the inner periphery sun gear, a crank shaft rotatably provided about the central axis of the pitch circle of the inner periphery sun gear, and an arm portion protruding in a radial direction of the crank shaft for rotatably supporting a rotation axis of the planetary gear, wherein an intermediate portion of the piston rod is pin-engaged along a circumference of the pitch circle of the planetary gear.

10. A cooling device, comprising: a cylinder unit comprising a compression cylinder accommodating therein a compression piston so as to allow reciprocating motion thereof and a plurality of expansion cylinders each accommodating therein an expansion piston so as to allow reciprocating motion thereof, the cylinders being provided along the same cylinder axis line with cylinder heads thereof facing away from each other; a piston rod for coupling together the compression piston and the expansion pistons of the cylinder unit and linearly reciprocating along the axis line of the cylinder unit; a crank mechanism comprising an inner periphery sun gear in which a central axis of a pitch circle thereof orthogonally crosses the cylinder axis line between the cylinders of the cylinder unit and which is fixedly provided in parallel to the cylinder axis line, a planetary gear having a pitch circle diameter which is one half of the pitch circle diameter of the inner periphery sun gear, the planetary gear being capable of rotating and revolving while meshing with the inner periphery sun gear, a crank shaft rotatably provided about the central axis of the pitch circle of the inner periphery sun gear, and an arm portion protruding in a radial direction of the crank shaft for rotatably supporting a rotation axis of the planetary gear, wherein an intermediate portion of the piston rod is pin-engaged along a circumference of the pitch circle of the planetary gear; a driving device for rotating the crank shaft; a compressed air supply passage for communicating a discharge port of the compression cylinder with an intake port of each expansion cylinder, the discharge port being provided for discharging a compressed air which is introduced through an intake port of the compression cylinder and compressed within the compression cylinder; a primary cooler provided along the compressed air supply passage; and a cold air discharge manifold for communicating together discharge ports for discharging the air whose temperature is reduced through adiabatic expansion within the respective expansion cylinders to the outside.

11. The cooling device according to claim 10, comprising a cam mechanism, wherein a cam follower is provided at a pin engagement section between the planetary gear and the piston rod, and a cam guide surface is set so that the planetary gear meshes with the sun gear on a front side with respect to a rotation direction thereof before the expansion piston reaches a top dead center.

12. The cooling device according to claim 11, wherein the cam mechanism has a cam guide surface which is set so that the planetary gear meshes with the sun gear on a front side with respect to a rotation direction thereof before the expansion piston reaches a bottom dead center.

13. A cooling device, comprising: a compression cylinder unit in which two compression cylinders each accommodating therein a compression piston so as to allow reciprocating motion thereof are provided along the same cylinder axis line with respective cylinder heads thereof facing away from each other; an expansion cylinder unit in which two expansion cylinders each accommodating therein a expansion piston so as to allow reciprocating motion thereof are provided along the same cylinder axis line with respective cylinder heads thereof facing away from each other; a plurality of piston rods provided respectively for the cylinder units, each piston rod coupling together the two pistons of each cylinder unit and linearly reciprocating along the axis line of the cylinder unit; a crank mechanism comprising an inner periphery sun gear in which a central axis of a pitch circle thereof orthogonally crosses the cylinder axis line between the cylinders of each cylinder unit and which is fixedly provided in parallel to the cylinder axis line, a planetary gear having a pitch circle diameter which is one half of the pitch circle diameter of the inner periphery sun gear, the planetary gear being capable of rotating and revolving while meshing with the inner periphery sun gear, a crank shaft rotatably provided about the central axis of the pitch circle of the inner periphery sun gear, and an arm portion protruding in a radial direction of the crank shaft for rotatably supporting a rotation axis of the planetary gear, wherein an intermediate portion of the piston rod is pin-engaged along a circumference of the pitch circle of the planetary gear; power transmission means for interlocking the crank shafts provided in the respective cylinder units with each other; a driving device for rotating the crank shaft; a compressed air supply passage for communicating a discharge port of each compression cylinder with an intake port of each expansion cylinder, the discharge port being provided for discharging a compressed air which is introduced through an intake port of the compression cylinder and compressed within the compression cylinder; a primary cooler provided along the compressed air supply passage; and a cold air discharge manifold for communicating together discharge ports for discharging the air whose temperature is reduced through adiabatic expansion within the respective expansion cylinders to the outside.

14. The cooling device according to any of claims 1 to 4, and claim 10 to 13 wherein a compressed air is supplied into the compressed air supply passage, the compressed air being produced by a pressurizing compressor which can be operated as necessary.

15. The cooling device according to claim 14, wherein an air pressure measuring sensor and a depressurizing device are provided along the compressed air supply passage, and a temperature sensor is provided in the cooling manifold, so that a pressure of the air within the compressed air supply passage is increased and decreased based on the temperature sensor and the air pressure measuring sensor so as to obtain a cold air of a desired temperature.

* * * * *